US007156675B2

(12) United States Patent
Nagata et al.

(10) Patent No.: US 7,156,675 B2
(45) Date of Patent: Jan. 2, 2007

(54) COAXIAL CONNECTOR WITH A SWITCH

(75) Inventors: Takayuki Nagata, Osaka (JP); Toru Imai, Osaka (JP)

(73) Assignee: Hosiden Corporation, Yao (JP)

( * ) Notice: Subject to any disclaimer, the term of this patent is extended or adjusted under 35 U.S.C. 154(b) by 0 days.

(21) Appl. No.: 11/174,725

(22) Filed: Jul. 6, 2005

(65) Prior Publication Data

US 2006/0009075 A1 Jan. 12, 2006

(30) Foreign Application Priority Data

Jul. 6, 2004 (JP) ..... 2004-198834
Apr. 18, 2005 (JP) ..... 2005-119286

(51) Int. Cl.
*H01R 29/00* (2006.01)

(52) U.S. Cl. ..... 439/188; 439/944

(58) Field of Classification Search ..... 439/63, 439/188, 944

See application file for complete search history.

(56) References Cited

U.S. PATENT DOCUMENTS

2001/0005645 A1* 6/2001 Zech et al. ..... 439/188

FOREIGN PATENT DOCUMENTS

JP 2889562 2/1999
JP 2003-56597 2/2003

* cited by examiner

*Primary Examiner*—Ross Gushi
(74) *Attorney, Agent, or Firm*—Bacon & Thomas

(57) ABSTRACT

The invention provides a coaxial connector with a switch in which the life property and contact reliability of a movable contact piece portion are improved, which is further miniaturized and low-profiled than the conventional art, and in which the component configuration is simple, and hence the production cost is low. According to the coaxial connector 1 with a switch, in accordance with fitting with a counter connector, a plug pin 100 is elastically contacted with the plug pin contact portion 57 of a movable contact piece portion 51, and the movable contact piece portion 51 is displaced in a direction substantially perpendicular to the direction of insertion and extraction of the plug pin against the spring force, and separated from the stationary contact portion 41.

4 Claims, 20 Drawing Sheets

10'
11'
12'
13'
14'
14a'
15'
16'
17'
17a'
19'
19a'
19b'
19c'
20'
21a'
21b'
22'
23'
A

COAXIAL CONNECTOR WITH A SWITCH

BACKGROUND OF THE INVENTION

1. Field of the Invention

The present invention relates to a coaxial connector with a switch (a receptacle with a switch) which is useful in an electronic apparatus, for example, a communication apparatus such as a portable telephone, and in which contacts are switched over by fitting with a counter connector (a plug attached to an end of a coaxial cable).

2. Description of the Prior Art

In a portable telephone, for example, a coaxial connector with a switch is surface mounted on a circuit board so that, when electrical characteristics of a high-frequency circuit is to be checked at factory shipment, the connection of the high-frequency circuit is switched from an antenna to a measuring apparatus by fitting with a counter connector connected to the measuring apparatus, and the high-frequency circuit is again connected to the antenna by disengaging the counter. In order to miniaturize and thin an apparatus in which the connector is used, such as a portable telephone, the connector is requested to realize miniaturization and low-profile as far as possible.

In order to realize miniaturization and low-profile of a coaxial connector with a switch, it is important to, in design of a plate-spring like movable contact piece member configured by a thin metal plate, reduce stress concentration and improve the life property against repetitive insertion and extraction. Conventionally, there is a technique in which a movable contact piece member is formed into an S-like section shape, whereby stress concentration is reduced and the life property is improved while the total length of the spring is increased and miniaturization is realized (for example, see "Japanese Patent No. 2,889,562"). However, the spring is formed in the direction of insertion and extraction of a plug pin, and hence low-profiling is limited. Furthermore, the contact load of a plug pin contact portion is changed by an insertion stroke of the plug pin. Therefore, the technique has problems such as that the electrical connection is unstable and the technique is not adequate to measure the high-frequency characteristics. Therefore, a coaxial connector with a switch has been developed in which a movable contact piece member is displaced in a direction substantially perpendicular to the direction of insertion and extraction of a plug pin, thereby switching over contacts (for example, see "Japanese Patent Application Laying-Open No. 2003-59597").

SUMMARY OF THE INVENTION

However, the conventional coaxial connector with a switch comprises four components of an insulation body, an external-conductor shell, and a stationary contact piece member and the movable contact piece member for a switch, and further comprises separate components such as: a sub substrate having solder connecting portions for surface-mounting to a printed circuit board; and relay pins for electrically connecting the stationary and movable contact piece members to the solder connecting portions of the sub substrate. Therefore, the connector has problems in that the number of components is large, that the structure is complicated, and that the component cost and the assembly cost are high. A plug pin contact portion of the movable contact piece member is formed into an L-like shape so that it elongates from a free side end portion of the movable contact piece member, passes below a plug pin insertion region, and rises in a lateral side area of the region. In accordance with fitting with a counter connector, a plug pin is contacted with the rising portion of the plug pin contact portion, and the whole plug pin contact portion is displaced in a direction substantially perpendicular to the direction of insertion and extraction of the plug pin, whereby a movable contact portion of the movable contact piece member is separated from a stationary contact portion against a spring force. Below the plug pin insertion region, therefore, a space for the thickness of the horizontal portion of the plug pin contact portion, and a sliding gap for the horizontal portion must be further ensured. As a result, the connector has a structure which is disadvantageous to low-profiling.

It is an object of the invention to provide a coaxial connector with a switch in which the life property and contact reliability of a movable contact piece portion are improved, which is further miniaturized and low-profiled than the conventional art, and in which the component configuration is simple, and hence the production cost is low.

In order to attain the object, the coaxial connector with a switch of the invention comprises:

a ceiled cylindrical insulation body which integrally has a pedestal portion on a bottom side, and in which a plug pin insertion hole is formed in a center area of a ceiling face, the plug pin insertion hole enabling a plug pin of a counter connector to be insertable and extractable along a cylinder axis in a center area inside a cylinder;

an external-conductor shell having a cylindrical shell body which is fitted to an outside of the cylinder of the insulation body, and a solder connecting portion which elongates integrally from the shell body along a bottom face of the insulation body;

a stationary connect member for a switch having a stationary contact portion which is housed and fixed to a position inside the cylinder of the insulation body and deviated from a plug pin insertion region, and a solder connecting portion which elongates integrally from the stationary contact portion along the bottom face of the insulation body; and a movable connect member having a plate-spring like movable contact piece portion configured by a thin metal plate, and a solder connecting portion which elongates integrally from the movable contact piece portion along the bottom face of the insulation body, the movable contact piece portion being housed in a cantilevered manner inside the cylinder of the insulation body and around the plug pin insertion region so that a plate width direction is in parallel with a direction of insertion and extraction of the plug pin, a free side end portion laterally passing a part of the plug pin insertion region to elongate to the stationary contact portion, and having a plug pin contact portion in a same plane as a movable contact portion which is elastically contacted with the stationary contact portion by a spring force, in accordance with fitting with the counter connector, the plug pin is elastically contacted with the plug pin contact portion, and the movable contact piece portion is displaced in a direction substantially perpendicular to the direction of insertion and extraction of the plug pin against the spring force, whereby the movable contact portion is separated from the stationary contact portion.

When the above-mentioned configuration is employed, the coaxial connector with a switch is configured only by the insulation body, the external-conductor shell, and the stationary connect member and the movable connect member for a switch. Namely, the connector is configured by the four components, or the components the number of which is minimum among coaxial connectors with a switch of this kind. Therefore, the component cost and assembly cost of the coaxial connector with a switch can be reduced, and at the same time the structure can be simplified.

The movable contact piece portion is displaced in a direction substantially perpendicular to the direction of insertion and extraction of the plug pin, and the displacement distance is decided only by the outer diameter of the plug pin, and the distance between the plug pin contact portion (contact face) and the axis of the plug pin, and is not changed by the insertion stroke of the plug pin. Therefore, stress acting on the movable contact piece portion, and the contact load of the plug pin contact portion are constant, whereby the electrical connection state is stabilized, and the contact reliability is improved. When the coaxial connector with a switch is used in, for example, a portable telephone, a measurement environment of excellent high-frequency characteristics is obtained.

The plate-spring like movable contact piece portion configured by a thin metal plate is housed inside the cylinder of the insulation body so that the plate width direction is in parallel with the direction of insertion and extraction of the plug pin. In order to obtain adequate spring characteristics, the shape of the movable contact piece portion is changed, or the length of the spring is changed, and, in order to disperse stress, a bending portion is added or eliminated, or a bending radius is changed. These countermeasures can be effectively realized simply by increasing or decreasing the sectional area of the movable contact piece portion in terms of space, and in a range where the space is increased or decreased in a reduced degree. Therefore, the life property and contact reliability of the movable contact piece portion can be improved, and the coaxial connector with a switch can be further miniaturized.

In the movable contact piece portion, the plug pin contact portion and the movable contact portion can be set in the free side end portion, simply by bending a rectangular thin metal plate in the length direction to be formed into a plate-spring like shape. Therefore, the shape of the movable connect member is simplified, and fine processing of the components can be easily conducted. The component cost and assembly cost of the coaxial connector with a switch can be further reduced.

The plug pin contact portion can elongate to the plug pin insertion region without passing below the plug pin insertion region. Therefore, even a space having the height of which is equal to the insertion stroke of the plug pin can accommodate the movable contact piece portion. The coaxial connector with a switch can be more low-profiled.

In the coaxial connector with a switch of the invention, preferably, a plug pin leading portion which is curved toward an outside of the plug pin insertion region is formed in the plug pin insertion side end of the plug pin contact portion. In the insulation body, preferably, plug pin insertion guide walls are formed at opposed positions across the plug pin insertion region inside the cylinder, the plug pin insertion guide walls hanging continuously from a hole wall of the plug pin insertion hole in the plug pin insertion direction. When this configuration is employed, the plug pin is inserted with being guided by the plug pin insertion guide walls in which a part of a cylinder is D-cut. Therefore, the plug pin is prevented from being inserted obliquely or in a state where the axis is largely eccentric. The plug pin leading portion enables the plug pin to be surely slidingly inserted to the side of the contact face of the plug pin contact portion. High contact reliability and a sure contact changeover operation of the switch are obtained.

Preferably, an edge portion formed by a plug pin leading face of the plug pin leading portion and a tip end face is chamfered. When this configuration is employed, the edge portion formed by the plug pin leading face of the plug pin leading portion and the tip end face can be prevented from being caught by the ceiling face portion of the body, thereby eliminating an operation failure caused by an interference between the movable contact piece portion and a body ceiling face portion. High contact reliability and a sure contact changeover operation of the switch are obtained.

In the movable contact piece portion, preferably, circumferential positions of all portions ranging from a fixed side end portion to the free side end portion are different from one another. When this configuration is employed, it is possible to eliminate portions which overlap with each other in a radial direction, the axial distance of which is very short, and which easily interfere with each other in high frequencies, the portions of the movable contact piece portion ranging from the fixed side end portion to the free side end portion. Furthermore, it is possible to eliminate portions which overlap with each other in a radial direction, which partly enter the plug pin insertion region, and which easily interfere with the plug pin in insertion and extraction of the plug pin, the portions of the movable contact piece portion ranging from the fixed side end portion to the free side end portion, and excluding the free side end portion.

According to the invention, it is possible to achieve remarkable effects that the life property and contact reliability of a movable contact piece portion can be improved, that further miniaturization and low-profiling of a coaxial connector with a switch can be realized, and that cost reduction can be realized by a simple component configuration.

Figure 1:
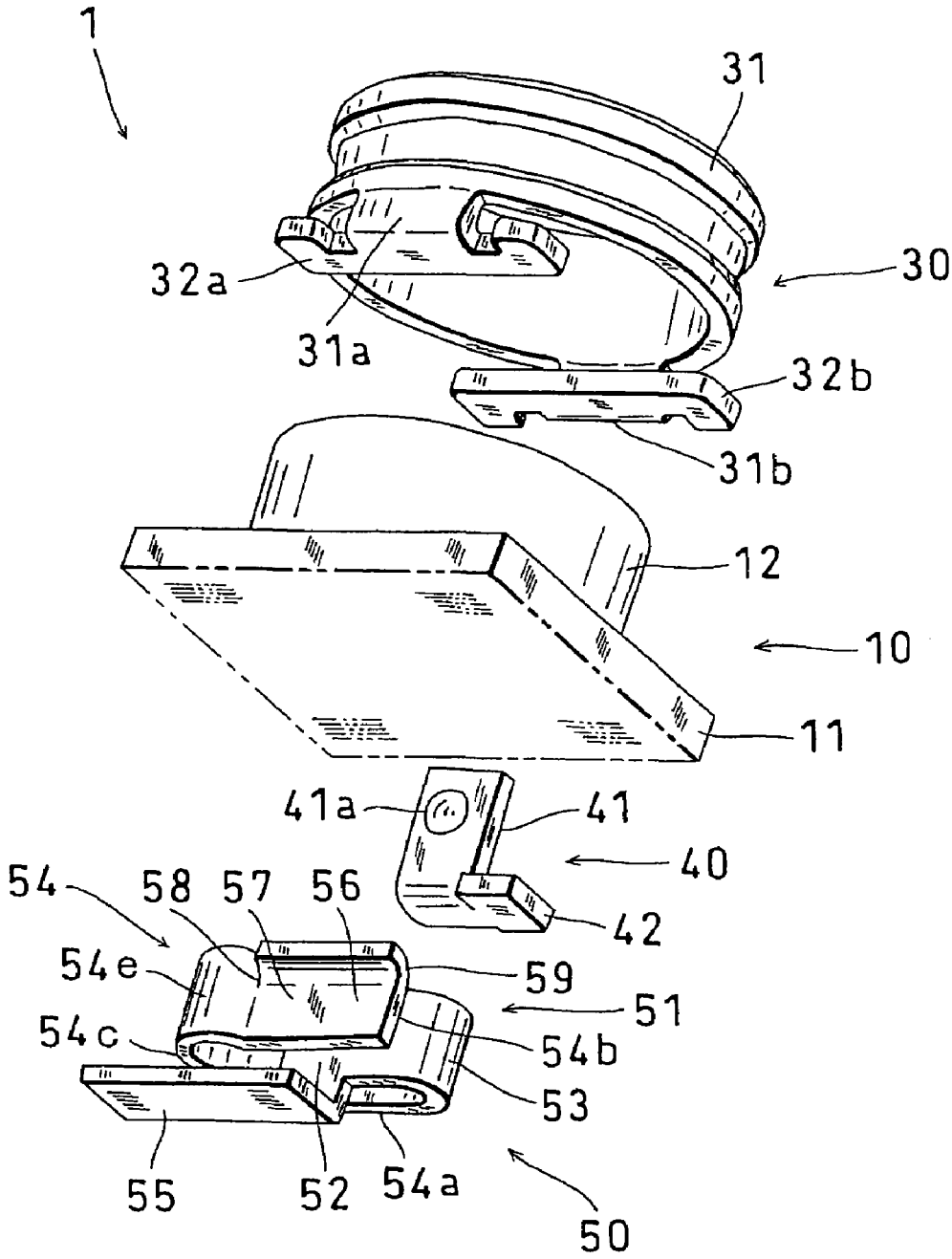
FIG. 1 is an exploded perspective view of a coaxial connector 1 with a switch of a first embodiment.
Figure 2D:
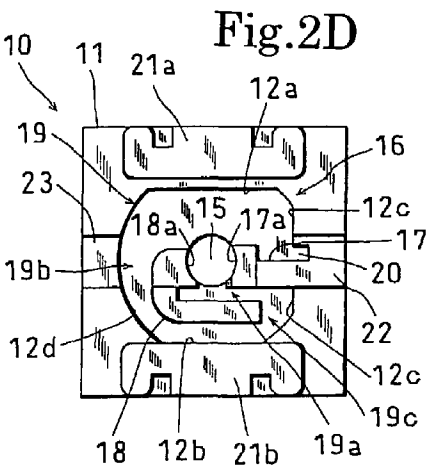
FIG. 2 is a view showing an insulation body 10 of the coaxial connector 1 with a switch of the first embodiment, wherein (a) is a front view (a view of the insulation body 10 seen in a direction of fitting to a counter connector), (b) is a plan view, (c) is a right side sectional view, (d) is a bottom view, and (e) is an A—A sectional view in the front view (a section of the insulation body 10 taken along a plane parallel to a plug pin insertion and extraction direction)
Figure 2C:
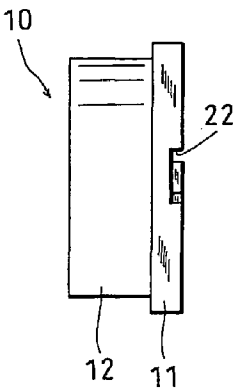
Figure 2B:
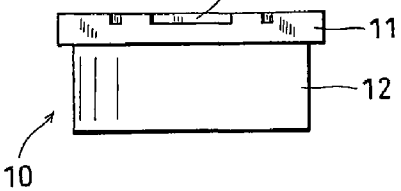
Figure 2A:
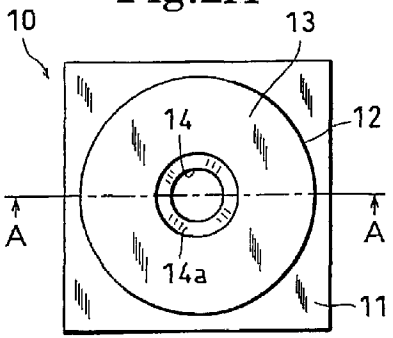
Figure 2E:
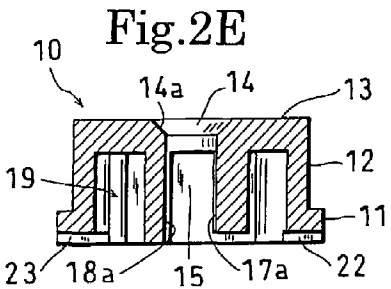

1, 1' coaxial connector with a switch
10, 10' insulation body
11, 11' pedestal portion
14, 14' plug pin insertion hole
15, 15' plug pin insertion region
17*a*, 18*a*, 17*a*' plug pin insertion guide wall
30, 30' external-conductor shell
31, 31' shell body
32*a*, 32*b*, 32' solder connecting portion
40, 40' stationary connect member
41, 41' stationary contact portion
42, 42' solder connecting portion
50, 50' movable connect member
51, 51' movable contact piece portion
51*c*' free side portion
54 spring portion
54*b* free side end portion
55, 55' solder connecting portion
56, 56' movable contact portion
57, 57' plug pin contact portion
59, 59' plug pin leading portion
59*a*' plug pin leading face
60, 60' changeover switch

DESCRIPTION OF THE PREFERRED EMBODIMENT

Hereinafter, a first embodiment of the invention will be described with reference to FIGS. 1 to 10. As shown in FIG. 1, a coaxial connector 1 with a switch is configured only by four components of an insulation body 10, an external-conductor shell 30, a stationary connect member 40 for a switch, and a movable connect member 50.

Next, each of the components will be described.

As shown in FIGS. 1 and 2, the insulation body 10 is made of an insulative resin material (for example, "LCP"), and formed into a ceiled cylindrical shape which integrally has a substantially parallelepiped pedestal portion 11 in the bottom side. The pedestal portion 11 is formed into a square plate-like shape. The length of one side of the square shape is approximately equal to a dimension which is obtained by adding the thickness of a thin metal plate forming the external-conductor shell 30 to the outer diameter of a cylindrical body 12, i.e., the outer diameter of the shell body 31 of the external-conductor shell 30. The body 12 is formed integrally perpendicularly at a concentric position of the upper face of the pedestal portion 11. In a center portion of a disk-like body ceiling face portion 13, formed is a circular plug pin insertion hole 14 through which a plug pin 100 (see FIG. 10) of a counter connector is insertable and extractable into a center area inside the body 12 along the axis of the body 12. Therefore, a thin columnar space which is in a center area inside the body 12, and which is coaxial with the axis of the body serves as a plug pin insertion region 15. The plug pin insertion hole 14 is formed as a taper hole in which the hole diameter is gradually reduced as further advancing from the outer face of the body ceiling face portion 13 toward the inner face, i.e., in the plug pin insertion direction. The plug pin insertion hole 14 is opened in the inner face of the body ceiling face portion 13 with a diameter which is slightly larger than the diameter of the plug pin 100. An inverted truncated cone-like hole wall of the plug pin insertion hole 14 is a leading face 14*a* for insertion of the plug pin 100.

Figure 7A:
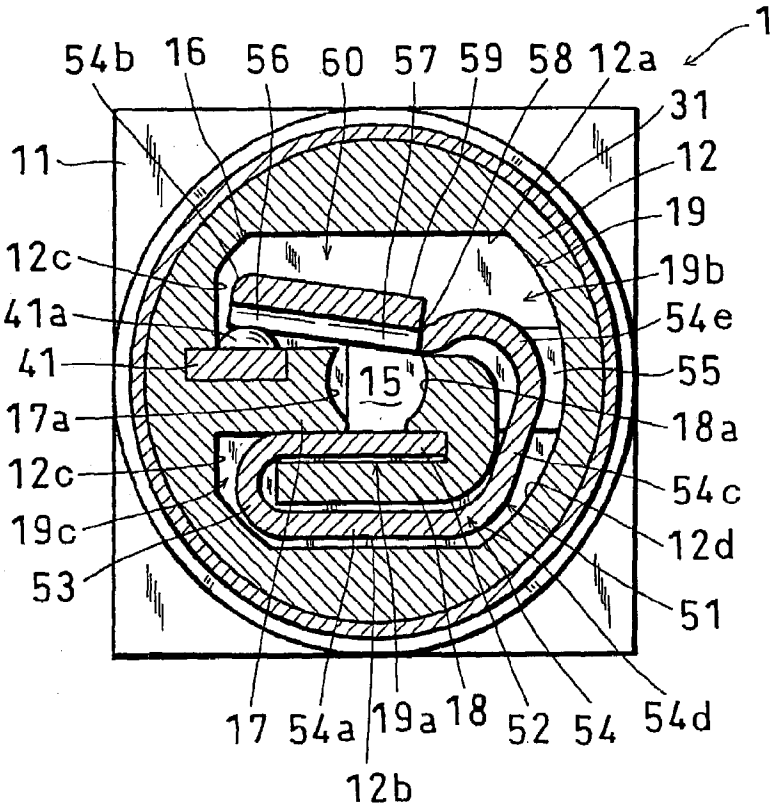
FIG. 7 is a B—B sectional view in the right side sectional view of (c) of FIG. 6 (a section of a body 12 of the coaxial connector 1 with a switch taken along a plane perpendicular to the plug pin insertion and extraction direction), wherein (a) is a sectional view when a plug pin 100 is not inserted, and (b) is a sectional view when the plug pin 100 is inserted.
Figure 7B:
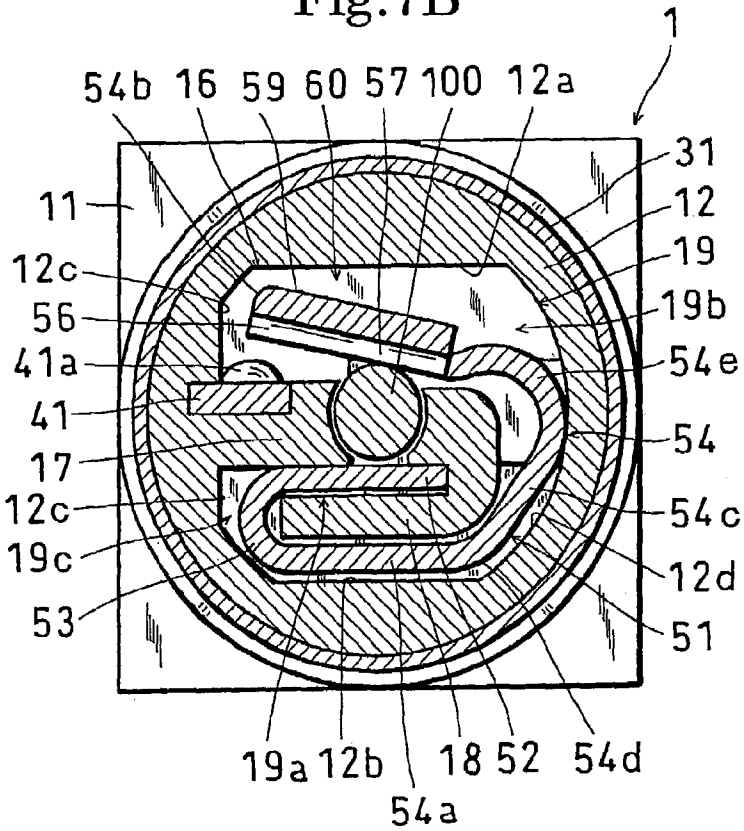
Figure 8:
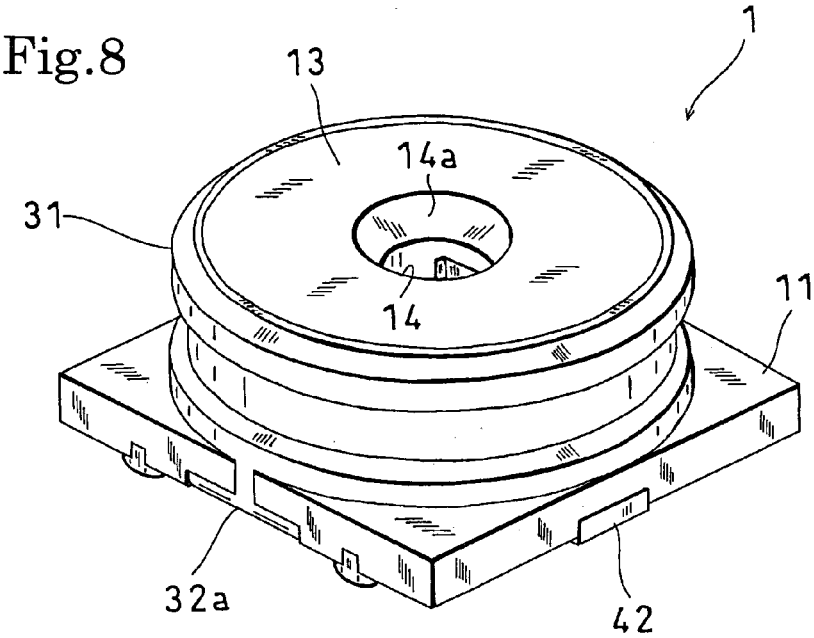
FIG. 8 is an external perspective view showing the coaxial connector 1 with a switch of the first embodiment.

As shown in FIG. 7 also, a switch housing chamber 16 is formed inside the body 12. The housing chamber is surrounded in the four directions by three or first, second, and third inner side walls 12*a*, 12*b*, and 12*c* which are parallel to three side faces of the pedestal portion 11, and a curved fourth inner side wall 12*d* which extends along the outer peripheral face of the body 12. The ceiling surface of the housing chamber is covered by the body ceiling face portion 13 in which the plug pin insertion hole 14 is formed in a center area. The switch housing chamber 16 is passed through the pedestal portion 11, and opened in the lower face of the portion, i.e., the bottom face of the insulation body 10. The switch housing chamber 16 comprises a first partition wall 17 having an I-like section shape, and a second partition wall 18 having a J-like section shape. The first partition wall 17 hangs integrally from the body ceiling face portion 13 between a width middle portion of the flat third inner side wall 12*c* opposed to the curved fourth inner side wall 12*d*, and the plug pin insertion region 15. One side end face of the first partition wall is coupled integrally with the width middle portion of the third inner side wall 12*c*, and the other side end face faces the plug pin insertion region 15. The second partition wall 18 hangs integrally from the body ceiling face portion 13 between one of the flat first and second inner side walls 12*a* and 12*b* opposed to each other (in the embodiment, the second inner side wall 12*b*), the embodiment, the second inner side wall 12*b*), and the first partition wall 17, and over a range from the curved fourth inner side wall 12*d* to the plug pin insertion region 15. One side end face of the second partition wall is opposed via a predetermined gap to the third inner side wall 12*c* between the second inner side wall 12*b* and the first partition wall 17, and the other side end face faces the plug pin insertion region 15 from the side opposite to the other side end face of the first partition wall 17. A movable contact piece housing groove 19 having a substantially "e"-like section shape is formed around the plug pin insertion region 15 in the switch housing chamber 16 by the first partition wall 17 and the second partition wall 18. The groove starts at a bending portion of the second partition wall 18, and ends in the third inner side wall 12*c* between the first inner side wall 12*a* and the first partition wall 17. The other side end face of the first partition wall 17, and that of the second partition wall 18 which are opposed to each other via the plug pin insertion region 15 are formed as a cylindrical surface which extends along the outer side face of the plug pin insertion region 15 (the outer side face of the plug pin 100). Plug pin insertion guide walls 17*a*, 18*a* in which a part of a cylinder is D-cut are formed at positions opposed to each other via the plug pin insertion region 15, in the switch housing chamber 16 by the other side end faces of the first partition wall 17 and the second partition wall 18. The walls 17*a*, 18*a* hang continuously from the hole wall of the plug pin insertion hole 14, i.e., the leading face 14*a*, in the plug pin insertion direction.

The movable contact piece housing groove 19 has: an inner groove portion 19*a* which starts at the bending portion of the second partition wall 18, and which is linearly formed between the second partition wall 18 and the first partition wall 17 so as to be directed tangentially immediately outside the plug pin insertion region 15 from the side of the fourth inner side wall 12*d* toward the third inner side wall 12*c* along the second inner side wall 12*b*; an outer peripheral groove portion 19*b* which is formed in a substantially U-like shape between the second partition wall 18 and the first partition wall 17, and a series of the second inner side wall 12*b*, the fourth inner side wall 12*d*, and the first inner side wall 12*a* so as to elongate around the outside of the plug pin insertion region 15 opposite to the inner groove portion 19*a*, from the outside of the inner groove portion 19*a* along the series of the second inner side wall 12*b*, the fourth inner side wall 12*d*, and the first inner side wall 12*a*; and a folded groove portion 19*c* which is formed in a substantially U-like shape between one side end face of the second inner side wall 12*b*, and the third inner side wall 12*c* so as to connect the terminal end of the inner groove portion 19*a* to the start end of the outer peripheral groove portion 19*b*. An terminal end portion of the outer peripheral groove portion 19*b* elongating around the outside of the plug pin insertion region 15 opposite to the inner groove portion 19*a* is linearly formed between the first inner side wall 12*a*, and the other side end portion of the second partition wall 18 opposed thereto and the first partition wall 17 so as to be directed tangentially with including a part of the plug pin insertion region 15 from the side of the fourth inner side wall 12*d* toward the third inner side wall 12*c*. A part of the plug pin insertion region 15 is protruded from an interrupted portion of a groove inner side wall of the terminal end portion of the outer peripheral groove portion 19*b*, i.e., from a portion between the plug pin insertion guide wall 18*a* on the side of the second partition wall 18 and the plug pin insertion guide wall 17*a* on the side of the first partition wall 17. The movable contact piece housing groove 19 is formed in the following manner. The inner groove portion 19*a* is formed to have a width which is substantially equal to the thickness of a thin metal plate forming the movable connect member 50, and has the narrowest width. The groove portion elongating to the start end of the outer peripheral groove portion 19*b* along the second inner side wall 12*b* via the folded groove portion 19*c* is formed to be slightly wider than the inner groove portion 19*a*. The middle portion of the outer peripheral groove portion 19*b* which is curved along the fourth inner side wall 12*d* is gradually increased in width. The terminal end portion of the outer peripheral groove portion 19*b* which extends along the first inner side wall to the outside of the plug pin insertion region 15 opposite to the inner groove portion 19*a* has the largest width.

In the insulation body 10, formed are a stationary contact portion housing groove 20 of the stationary connect member 40, a pair of solder connecting portion housing grooves 21*a*, 21*b* of the external-conductor shell 30, a solder connecting portion housing groove 22 of the stationary connect member 40, and a solder connecting portion housing groove 23 of the movable connect member 50. The stationary contact portion housing groove 20 is formed at a terminal end portion of the outer peripheral groove portion 19*b* as a recess in a wall face of the first partition wall 17 opposed to the first inner side wall 12*a*, and the other solder connecting portion housing grooves 21*a*, 21*b*, 22, 23 are formed as recesses in the lower face of the pedestal portion 11, i.e., the bottom face of the insulation body 10.

Figure 3B:
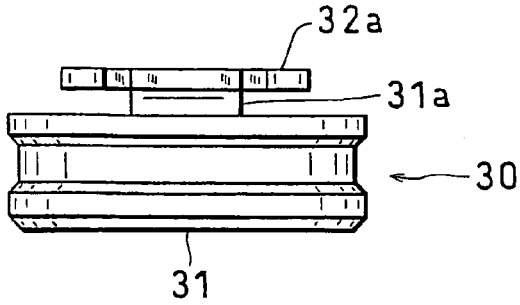
FIG. 3 is a view showing an external-conductor shell 30 of the coaxial connector 1 with a switch of the first embodiment, wherein (a) is a front view (a view of the external-conductor shell 30 seen in the direction of fitting to the counter connector), (b) is a plan view, and (c) is a right side sectional view.
Figure 3A:
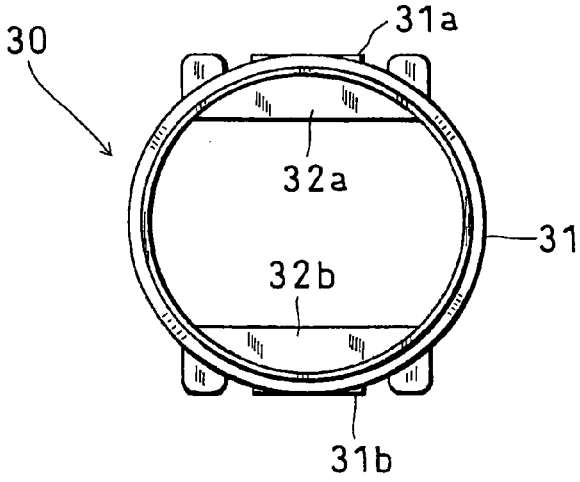
Figure 3C:
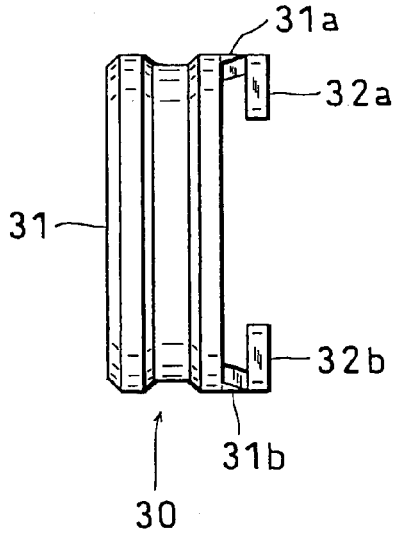

As shown in FIGS. 1, 3, and 7, the external-conductor shell 30 is configured by a conductive metal plate (for example, "copper alloy"), and has: a cylindrical shell body 31 which is fitted to the outside of the body 12; and a pair of solder connecting portions 32*a*, 32*b* which elongate integrally from lower end symmetrical positions of the shell body 31 along the lower face of the pedestal portion 11, i.e., the bottom face of the insulation body 10 via bent piece portions 31*a*, 31*b*. Before the external-conductor shell 30 is installed to the insulation body 10, the solder connecting portions 32*a*, 32*b* elongate in a hanging sate from the lower end symmetrical positions of the shell body 31. During an installing process, the solder connecting portions are inward bent at right angle, and fitted into the solder connecting portion housing grooves 21*a*, 21*b* formed in the bottom face of the insulation body 10. The solder connecting portion housing grooves 21*a*, 21*b* are formed so that their depths are slightly shallower than the thicknesses of the solder connecting portions 32*a*, 32*b*, and the lower surfaces of the solder connecting portions 32*a*, 32*b* are exposed from the bottom face of the insulation body 10 in a slightly protruded state.

Figure 4B:
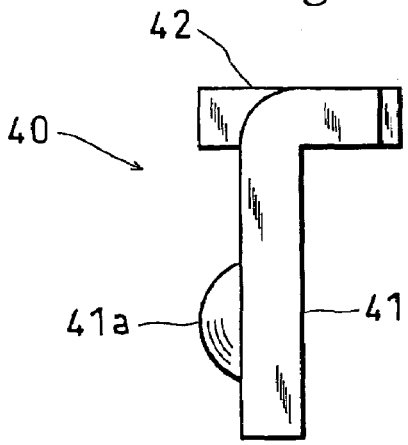
FIG. 4 is a view showing a switch stationary connect member 40 of the coaxial connector 1 with a switch of the first embodiment, wherein (a) is a front view (a view of the stationary connect member 40 seen in the direction of fitting to the counter connector), (b) is a plan view, and (c) is a right side sectional view.
Figure 4A:
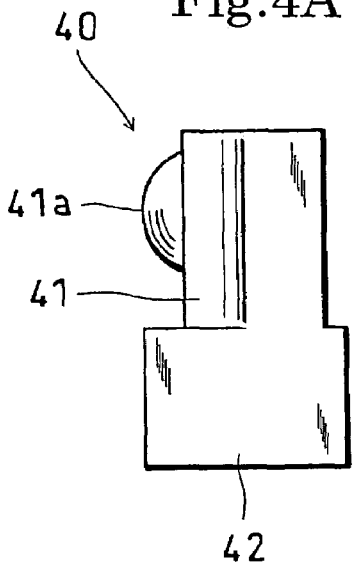
Figure 4C:
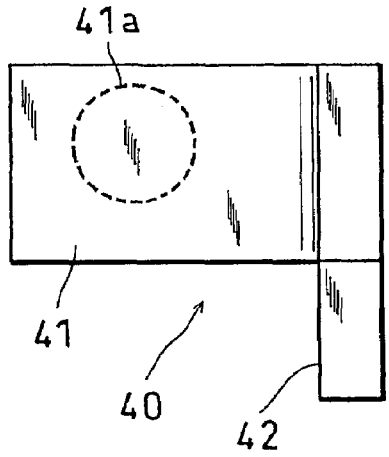

As shown in FIGS. 1, 4, and 7, the stationary connect member 40 is produced by stamping out a substantially L-like shape from a conductive metal plate (for example, "copper alloy"), and then bending one end at right angle with respect to the other end. The stationary connect member 40 has: a stationary contact portion 41 which is fitted into the stationary contact portion housing groove 20 of the insulation body 10, and which is housed and fixed at a position deviated from the plug pin insertion region 15 in the switch housing chamber 16; and a solder connecting portion 42 which elongates integrally perpendicularly from the lower end of the stationary contact portion 41 along the bottom face of the insulation body 10. The stationary contact portion housing groove 20 houses and fixes the stationary contact portion 41 in a state where it is embedded in the first partition wall 17 opposed to the first inner side wall 12*a*, and an groove inner side wall of the terminal end of the outer peripheral groove portion 19*b* is configured by a metal surface of the stationary contact portion 41, thereby allowing the metal surface of the stationary contact portion 41 to be exposed in a flush state from the wall face of the first partition wall 17 in a terminal end portion of the outer peripheral groove portion 19*b*. A stationary contact 41*a* is inflatingly formed in a spherical manner on the metal surface of the stationary contact portion 41 which is exposed in a flush state from the groove inner side wall of the terminal end of the outer peripheral groove portion 19*b*. Also in the solder connecting portion housing groove 22 in the bottom face of the insulation body 10 to which the solder connecting portion 42 is fitted is formed so that its depth is slightly shallower than the thickness of the solder connecting portion 42, and the lower face of the solder connecting portion 42 is exposed from the bottom face of the insulation body 10 in a slightly protruded state, in the same plane as the lower surfaces of the solder connecting portions 32*a*, 32*b* of the external-conductor shell 30.

Figure 5B:
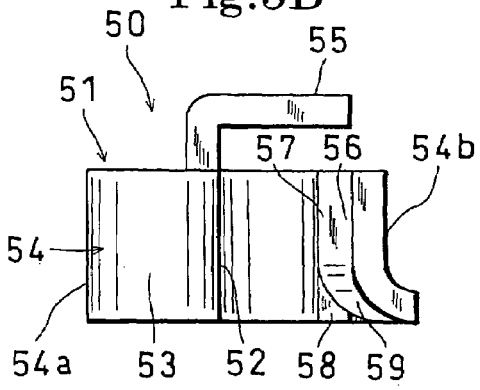
FIG. 5 is a view showing a switch movable connect member 50 of the coaxial connector 1 with a switch of the first embodiment, wherein (a) is a front view (a view of the movable connect member 50 seen in the direction of fitting to the counter connector), (b) is a plan view, and (c) is a right side sectional view.
Figure 5A:
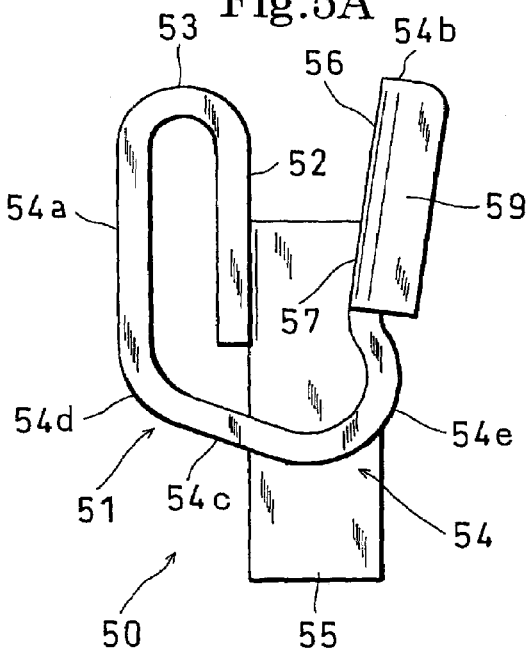
Figure 5C:
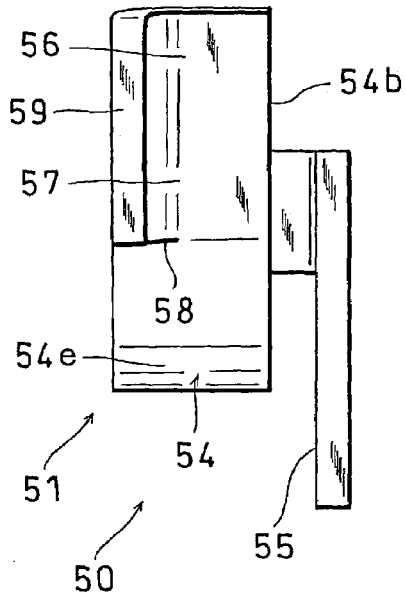
Figure 6B:
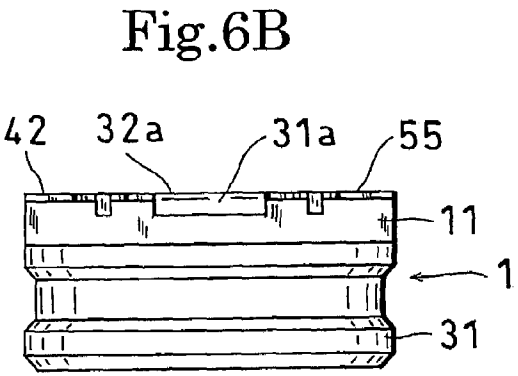
FIG. 6 is a view showing the coaxial connector 1 with a switch of the first embodiment, wherein (a) is a front view (a view of the coaxial connector 1 with a switch seen in the direction of fitting to the counter connector), (b) is a plan view, (c) is a right side sectional view, and (d) is a bottom view.
Figure 6C:
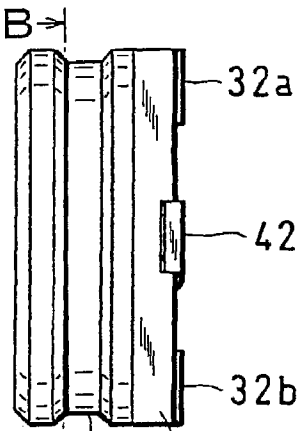
Figure 6A:
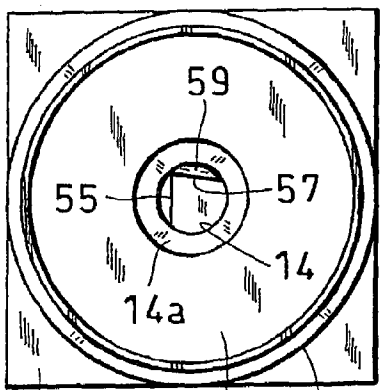
Figure 6D:
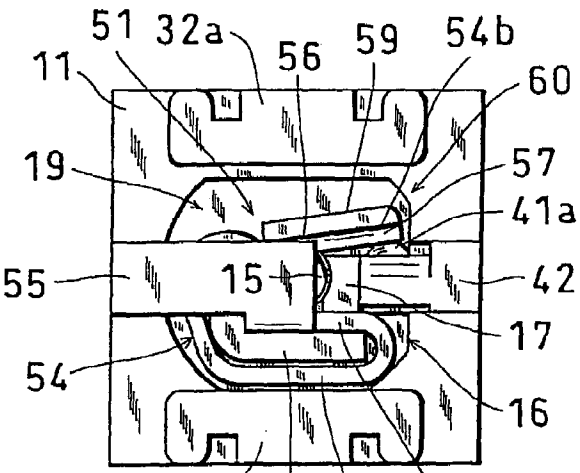

As shown in FIGS. 1, 5, and 7, the movable connect member 50 is produced by stamping out a substantially L-like shape from a conductive thin metal plate (for example, "copper alloy") so that one end is very longer than the other end, bending the longer end along the longitudinal direction, and bending the shorter end at right angle with respect to the longer end. The movable connect member 50 has: a movable contact piece portion 51 which is housed in the movable contact piece housing groove 19 of the insulation body 10; and a solder connecting portion 55 which elongates integrally perpendicularly from the lower end of the fixed side of the movable contact piece portion 51 along the bottom face of the insulation body 10. The movable contact piece portion 51 is formed by bending a slender thin metal plate having a rectangular shape in the longitudinal direction into a substantially "e"-like section shape, and has: a substantially U-like spring portion 54 which is to be fitted into the substantially U-like outer peripheral groove portion 19*b*; a fixed end portion 52 which is continuous from one end of the spring portion 54 in an inward bent state, and which is to be fitted and fixed to the inner groove portion 19*a*; and a folded portion 53 of the fixed end portion 52 which is to be fitted into the folded groove portion 19*c*. The movable contact piece portion is formed to be housed around the plug pin insertion region 15 in a cantilevered state by the movable contact piece housing groove 19 so that the plate width direction is parallel to the direction of insertion and extraction of the plug pin. The spring portion 54 passes the outside of the plug pin insertion region 15 on the side of the fixed end portion 52, the outer peripheral groove portion 19*b*, and the outside of the plug pin insertion region 15 on the side opposite to the fixed end portion 52. The spring portion 54 is formed so that, in a free state, the interval between a fix side end portion 54*a* continuous to the fixed end portion 52 and a free side end portion 54*b* opposite thereto is narrower than that between the start end portion of the outer peripheral groove portion 19*b* along the second inner side wall 12*b*, and the terminal end portion of the outer peripheral groove portion 19*b* along the first inner side wall 12*a*. When the movable contact piece portion 51 is housed in the movable contact piece housing groove 19, therefore, the free side end portion 54*b* of the spring portion 54 which is fitted into the terminal end portion of the outer peripheral groove portion 19*b* is always urged by the spring force of the spring portion 54 against the groove inner side wall of the terminal end of the outer peripheral groove portion 19*b* in which the plug pin insertion region 15 is partly protruded, laterally passes the part of the plug pin insertion region 15 to elongate to a position opposed to the stationary contact portion 41, and is elastically displaceable in the terminal end portion of the outer peripheral groove portion 19*b* in a direction substantially perpendicular to the direction of insertion and extraction of the plug pin. The free side end portion 54*b* has a plug pin contact portion 57 in the same plane as a movable contact portion 56 which is to be elastically contacted with the stationary contact 41*a* of the stationary contact portion 41. Namely, in the metal surface of the free side end portion 54*b* of the spring portion 54 which is opposed to the groove inner side wall of the terminal end of the outer peripheral groove portion 19*b* where the plug pin insertion region 15 is partly protruded and the stationary contact 41*a* is inflated on the further terminal end side, and which is contactable to and separable from the groove inner side wall, the plug pin contact portion 57 is disposed in the basal end portion, and the movable contact portion 56 is disposed in the tip end portion.

The spring portion 54 has: the flat fix side end portion 54*a* which is fitted into the start end portion of the outer peripheral groove portion 19*b* along the second inner side wall 12*b*; the flat free side end portion 54*b* which is fitted into the terminal end portion of the outer peripheral groove portion 19*b* along the first inner side wall 12*a*; a flat middle portion 54*c* which is fitted into a middle portion of the outer peripheral groove portion 19*b* along the curved fourth inner side wall 12*d*; a first bent portion 54*d* which connects the fix side end portion 54*a* and the middle portion 54*c*; and a second bent portion 54*e* which connects the middle portion 54*c* and the free side end portion 54*b*. The spring portion 54 is designed so that it is formed into a substantially U-like shape as a whole, and stress is received distributedly by the two bent portions 54*d*, 54*e*. Furthermore, the spring portion 54 is designed so that the first bent portion 54*d* and the second bent portion 54*e* are formed so as to make the bending angle of the flat free side end portion 54*b* with respect to the middle portion 54*c* to be smaller than that of the middle portion 54*c* with respect to the fix side end portion 54*a* (for example, the former is an acute angle, and the latter is an obtuse angle), and the free side end portion 54*b* is elastically displaced with setting the second bent portion 54*e* as the fulcrum while the middle portion 54*c* and the free side end portion 54*b* are integrally elastically displaced with setting the first bent portion 54*d* as the fulcrum.

A notch 58 having a predetermined length along the plate width direction in an upper end portion serving as a plug insertion side end portion is formed, in the base end portion of the free side end portion 54*b* of the spring portion 54. The whole length of the upper end portion of the free side end portion 54*b* which is more forward than the notch 58 is bent toward the outside of the plug pin insertion region 15 so that the upper end face is directed to the first inner side wall 12*a*. In the upper end portion of the free side end portion 54*b*, a bent portion which is outward bent is formed in the plate width direction over the whole length. A bent portion which is curved toward the outside of the plug pin insertion region 15 with being continuous to the plug pin insertion side end portion of the plug pin contact portion 57 is a plug pin leading portion 59 which, when the plug pin 100 is inserted, leads the plug pin 100 toward the metal surface of the free side end portion 54*b* which is opposed to the groove inner side wall of the terminal end of the outer peripheral groove portion 19*b* where the plug pin insertion region 15 is partly protruded and the stationary contact 41*a* is inflated on the further terminal end side, and which is contactable to and separable from the groove inner side wall, i.e., a plug pin contact face of the plug pin contact portion 57. The width of the thin metal plate of the spring portion 54 is set so that the plate width of the free side end portion 54*b* is larger by the bending degree of the plug pin leading portion 59 than that of the spring portion 54 other than the free side end portion 54*b*, and the level of the upper end portion of the free side end portion 54*b*, i.e., the level of the leading face of the plug pin leading portion 59 is not lower than or is aligned with the level of the upper end portion of the spring portion 54 other than the free side end portion 54*b*.

The solder connecting portion 55 of the movable connect member 50 elongates perpendicularly integrally from the lower end of the fixed end portion 52 of the movable contact piece portion 51 along the bottom face of the insulation body 10. Also the solder connecting portion housing groove 23 of the bottom face of the insulation body 10 into which the solder connecting portion 55 is fitted is formed so that its depth is slightly shallower than the thickness of the solder connecting portion 55, and the lower face of the solder connecting portion 55 is exposed from the bottom face of the insulation body 10 in a slightly protruded state, in the same plane as the lower surfaces of the solder connecting portions 32*a*, 32*b* of the external-conductor shell 30 and the solder connecting portion 42 of the stationary connect member 40.

Next, the assembling of the coaxial connector 1 with a switch will be described. Since the coaxial connector 1 with a switch is configured only by the four components of the insulation body 10, the external-conductor shell 30, the stationary connect member 40, and the movable connect member 50, the state shown in FIGS. 6 to 10 can be assembled by three steps, or a step of installing the external-conductor shell 30 to the insulation body 10, that of installing the stationary connect member 40 to the insulation body 10, and that of installing the movable connect member 50 to the insulation body 10.

The installation of the external-conductor shell 30 to the insulation body 10 can be conducted in the following manner. The shell body 31 in which the pair of solder connecting portions 32*a*, 32*b* elongate in a hanging sate from the lower end symmetrical positions are fitted onto the outside of the body 12. Thereafter, the solder connecting portions 32*a*, 32*b* are bent along the bottom face of the insulation body 10, and fitted into the solder connecting portion housing grooves 21*a*, 21*b* formed in the bottom face of the insulation body 10.

The installation of the stationary connect member 40 to the insulation body 10 can be conducted in the following manner. The stationary contact portion 41 is pressingly fixed from the side of the bottom of the insulation body 10 to the stationary contact portion housing groove 20 which is formed in a recessed manner in the wall face of the first partition wall 17 opposed to the first inner side wall 12*a*, in the terminal end of the outer peripheral groove portion 19*b* of the movable contact piece housing groove 19 of the insulation body 10. The solder connecting portion 42 is fitted into the solder connecting portion housing groove 22 formed in the bottom face of the insulation body 10.

The installation of the movable connect member 50 to the insulation body 10 can be conducted in the following manner. The movable contact piece portion 51 is fitted from the side of the bottom of the insulation body 10, into the movable contact piece housing groove 19 of the insulation body 10 so that the plate width direction is parallel to the direction of insertion and extraction of the plug pin. The solder connecting portion 55 is fitted into the solder connecting portion housing groove 23 formed in the bottom face of the insulation body 10. In this step, the bent portion formed over the whole length of the upper end portion of the free side end portion 54*b* of the spring portion 54 in the movable contact piece portion 51, i.e., the plug pin leading portion 59 functions as a spring expanding guide when the free side end portion 54*b* of the spring portion 54 is fitted into the terminal end of the outer peripheral groove portion 19*b* of the movable contact piece housing groove 19, thereby enabling the spring portion 54 in a free state to be fitted into the outer peripheral groove portion 19*b*. Therefore, the fitting of the movable contact piece portion 51 into the movable contact piece housing groove 19 is conducted smoothly and easily, and the step of installing the movable connect member 50 can be simplified. As a result, the assembly of the coaxial connector 1 with a switch can be simplified. When installing the movable connect member 50, it is not necessary to forcedly expand the spring portion 54 of the movable contact piece portion 51. Therefore, a change, degradation, and loss of the spring characteristics of the movable contact piece portion 51 which may be caused by forced expansion of the spring portion 54, and it is possible to prevent a defective connector from being assembled.

The coaxial connector 1 with a switch can be assembled irrespective of the sequence of the three steps. Preferably, the step of installing the stationary connect member 40 to the insulation body 10 is conducted before that of installing the movable connect member 50 to the insulation body 10 because of the following reason. When the step of installing the stationary connect member 40 to the insulation body 10 is conducted after that of installing the movable connect member 50 to the insulation body 10, the movable contact piece portion 51 of the movable connect member 50 may interfere with the press insertion of the stationary contact portion 41 of the stationary connect member 40 into the stationary contact portion housing groove 20.

When the coaxial connector 1 with a switch is assembled as a result of the three steps, as shown in FIGS. 6 to 10, the shell body 31 of the external-conductor shell 30 is fitted to the outside of the body 12 of the insulation body 10. A normally closed changeover switch 60 configured by: the stationary contact portion 41 of the stationary connect member 40 housed in the stationary contact portion housing groove 20; and the movable contact piece portion 51 of the movable connect member 50 housed in the movable contact piece housing groove 19 is housed in the switch housing chamber 16 of the body 12 communicating with the outside of the insulation body 10 via the plug pin insertion hole 14 formed in the center area of the ceiling face portion 13 of the insulation body 10. The solder connecting portions 32*a*, 32*b* of the external-conductor shell 30, the solder connecting portion 42 of the stationary connect member 40, and the solder connecting portion 55 of the movable connect member 50 are exposed from the lower face of the pedestal portion 11 of the insulation body 10, i.e., the bottom face of the insulation body 10, in a noncontact state where the solder connecting portions are separated from each other, in a state where the lower surfaces of the solder connecting portions are slightly protruded from the bottom face of the insulation body 10, and in one plane which is parallel to the bottom face of the insulation body 10. As a result, the surface mount type coaxial connector 1 with a switch incorporating the normally closed changeover switch 60 is obtained.

Since the stationary contact portion 41 of the changeover switch 60 is housed in the stationary contact portion housing groove 20, the metal surface of the stationary contact portion 41 on which the stationary contact 41*a* is inflatingly formed in a spherical manner is exposed in a flush state from the wall face of the first partition wall 17 opposed to the first inner side wall 12*a* in the terminal end portion of the outer peripheral groove portion 19*b* of the movable contact piece housing groove 19, the groove inner side wall of the terminal end of the outer peripheral groove portion 19*b* is configured by a metal surface, and the stationary contact 41*a* is protruded from the metal surface to the outer peripheral groove portion 19*b*. By contrast, since the movable contact piece portion 51 of the changeover switch 60 is housed in the movable contact piece housing groove 19, the fixed end portion 52 of the movable contact piece portion 51 is fitted and fixed to the inner groove portion 19*a* of the movable contact piece housing groove 19, the spring portion 54 of the movable contact piece portion 51 which is continuous from the fixed end portion 52 via the folded portion 53 is fitted into the outer peripheral groove portion 19*b* of the movable contact piece housing groove 19 and supported around the plug pin insertion region 15 in a cantilevered state, and in a state where the plate width direction is parallel to the direction of insertion and extraction of the plug pin, the free side end portion 54*b* of the spring portion 54 elongates to the outside of the plug pin insertion region 15 opposite to the fixed end portion 52, always urged by the spring force of the spring portion 54 toward the groove inner side wall of the terminal end of the outer peripheral groove portion 19*b* wherein the part of the plug pin insertion region 15 is protruded, and laterally passes the part of the plug pin insertion region 15 to elongate to the position opposed to the stationary contact portion 41, and the movable contact portion 56 which is set to the tip end portion of the free side end portion 54*b* is elastically contacted with the stationary contact 41*a* of the stationary contact portion 41 in a state where the plug pin contact portion 57 which is set in the basal end portion of the free side end portion 54*b* enters a part of the plug pin insertion region 15. The stationary contact portion 41 and the movable contact piece portion 51 which are formed as described above enable the normally closed changeover switch 60 to be configured and incorporated in the switch housing chamber 16 of the body 12.

The coaxial connector 1 with a switch which is obtained as described above is surface mounted on a printed circuit board (not shown) so that the bottom face of the insulation body 10 is joined to a mounting surface of the printed circuit board on which the connector is to be mounted, whereby the solder connecting portions 32*a*, 32*b* of the external-conductor shell 30, the solder connecting portion 42 of the stationary connect member 40, and the solder connecting portion 55 of the movable connect member 50 which are exposed from the bottom face of the insulation body 10 are soldered to corresponding patterns of the printed circuit board. In the embodiment, the coaxial connector 1 with a switch is surface mounted on a printed circuit board of a portable telephone so that the solder connecting portions 32*a*, 32*b* of the external-conductor shell 30 are electrically connected to a ground pattern of the printed circuit board, the solder connecting portion 42 of the stationary connect member 40 is electrically connected to an antenna of the portable telephone via a pattern of the printed circuit board, the solder connecting portion 55 of the movable connect member 50 is electrically connected to a high-frequency circuit of the portable telephone, and the changeover switch 60 is connected between the high-frequency circuit of the portable telephone and the antenna. Next, the function of the coaxial connector 1 with a switch of the embodiment will be described with reference to FIGS. 7 and 10. In this case, the counter connector is a measurement probe connected to a measurement apparatus which checks electrical characteristics of a high-frequency circuit. In the probe, as well known in the art, the plug pin 100 is disposed at the center of a cylindrical external conductor which is not shown.

In the coaxial connector 1 with a switch, as shown (a) of FIG. 7, before the counter connector is fitted and the plug pin 100 is inserted, the movable contact portion 56 of the movable connect member 50 is elastically contacted by the spring force of the spring portion 54 with the stationary contact 41*a* of the stationary connect member 40, and the high-frequency circuit and the antenna are electrically connected to each other via the connect members 50, 40 and the patterns of the printed circuit board.

Figure 9:
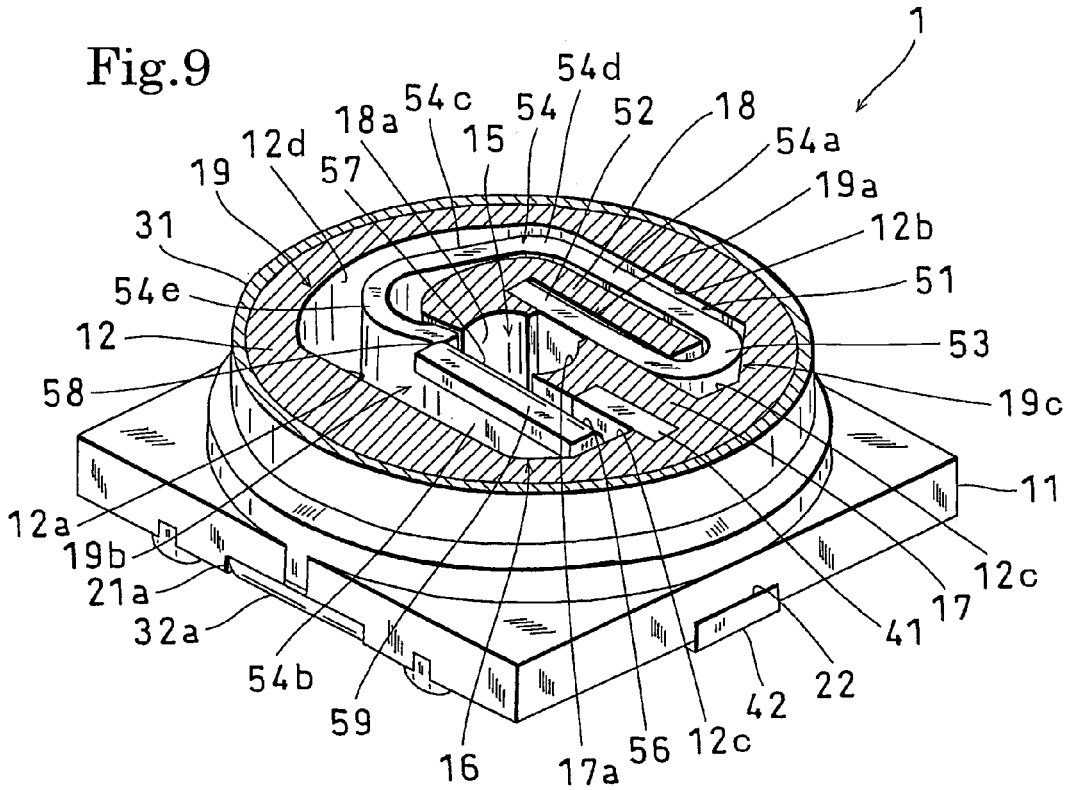
FIG. 9 is a cross-sectional perspective view showing the interior of the coaxial connector 1 with a switch of the first embodiment.
Figure 10:
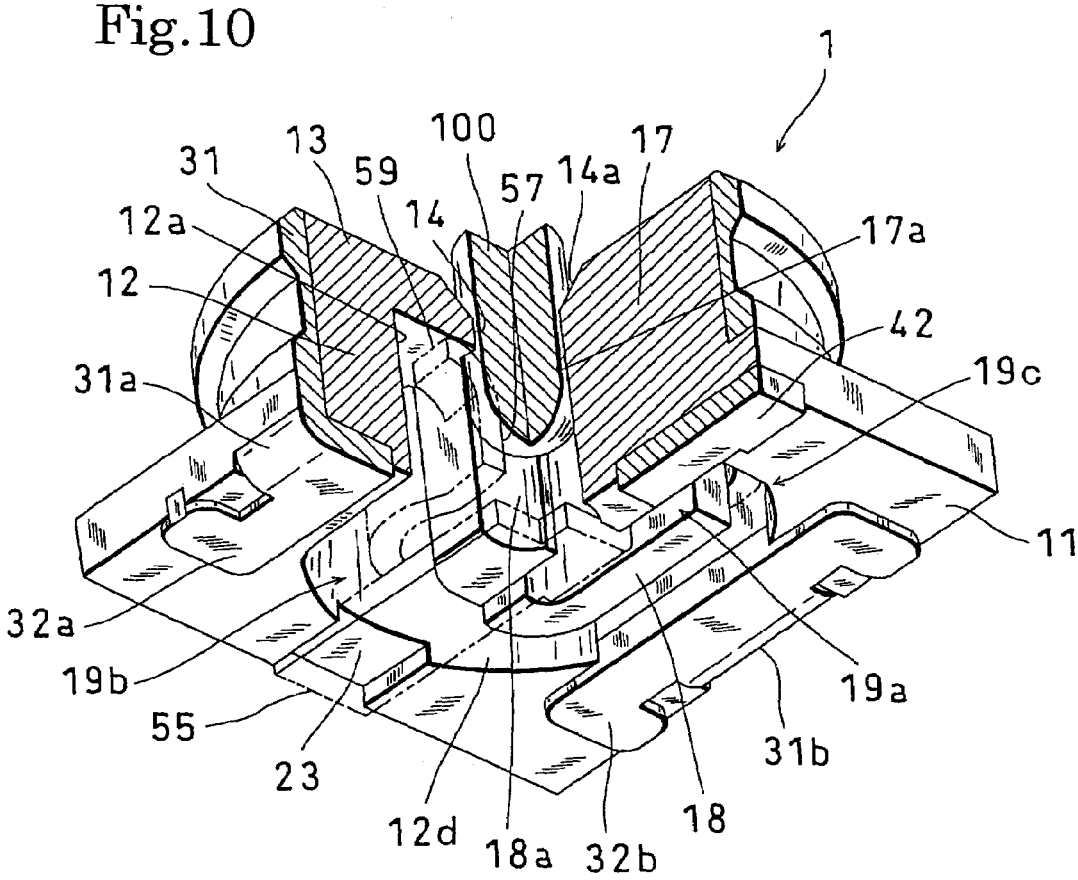
FIG. 10 is a perspective view showing the interior of the coaxial connector 1 with a switch of the first embodiment in a state where the plug pin 100 is inserted.

When the counter connector is fitted to the coaxial connector 1 with a switch, as shown (b) of FIG. 7 and FIG. 9, the plug pin 100 is guided from the plug pin insertion hole 14 by the leading face 14*a* and the plug pin insertion guide walls 17*a*, 18*a* in accordance with the fitting, and inserted along the axis of the body 12 to the plug pin insertion region 15 in the center area inside the body 12. During this insertion process, a spherical tip end face of the plug pin 100 is in sliding contact with the roll surface of the plug pin leading portion 59, and the plug pin contact portion 57 is displaced against the spring force of the spring portion 54 in a direction perpendicular to the direction of insertion and extraction of the plug pin so that the plug pin contact portion 57 is pushed and retracted toward a radial outside of the plug pin insertion region 15 (the plug pin 100), whereby the plug pin 100 is inserted with being in sliding contact with the plug pin contact face of the plug pin contact portion 57. As a result, the plug pin contact portion 57 is elastically contacted with the outer side face of the plug pin 100, the movable contact portion 56 which is disposed in the same plane as the plug pin contact portion 57 is separated from the stationary contact 41*a* of the stationary contact portion 41, and the connection of the high-frequency circuit is switched from the antenna to the measurement apparatus via the plug pin 100.

The spring portion 54 of the movable contact piece portion 51 passes the outer peripheral groove portion 19*b* which is formed in the outermost side of the switch housing chamber 16, and enters from the outside of the plug pin insertion region 15 on the side of the fixed end portion 52 to the outside of the plug pin insertion region 15 opposite to the fixed end portion 52. Therefore, the spring portion has a sufficient spring length. Furthermore, the spring portion 54 has the first bent portion 54*d* and the second bent portion 54*e*, and is designed so that stress is received distributedly by the two bent portions 54*d*, 54*e*. Therefore, a large bending moment is not partly produced, the spring characteristics are hardly impaired by repetitive insertion and extraction of the plug pin 100, and the life property against repetitive insertion and extraction of the plug pin 100 can be improved. The plug pin contact portion 57 and the movable contact portion 56 are disposed in the same plane of the free side end portion 54*b* in which the plate width direction of the spring portion 54 is parallel to the direction of insertion and extraction of the plug pin, the plug pin contact portion 57 is disposed on the basal end side of the free side end portion 54*b*, and the movable contact portion 56 is disposed on the tip end side of the free side end portion 54*b*. Therefore, the ratio of the displacement distances of the plug pin contact portion 57 and the movable contact portion 56 is not 1 to 1, and the displacement distance of the movable contact portion 56 is larger than that of the plug pin contact portion 57. Consequently, it is possible to obtain a sure contact changeover operation of the changeover switch 60. Conversely, the displacement distance of the movable contact portion 56 which is necessary for the contact changeover operation of the changeover switch 60 can be obtained by the displacement distance of the plug pin contact portion 57 which is smaller than that of the movable contact portion 56. Consequently, the elastic displacement distance of the spring portion 54 can be reduced. This is effective in improvement of the life property of the movable contact piece portion 51, and also in miniaturization of the coaxial connector 1 with a switch.

When the counter connector is disengaged from the coaxial connector 1 with a switch, the plug pin 100 is pulled out from the switch housing chamber 16 of the body 12 of the insulation body 10, the contact between the plug pin contact portion 57 and the plug pin 100 is broken, and, by the spring force of the spring portion 54, the movable contact portion 56 is again elastically contacted with the stationary contact 41*a* of the stationary contact portion 41, and the plug pin contact portion 57 is elastically restored to the position where the plug pin contact portion 57 enters a part of the plug pin insertion region 15, whereby the high-frequency circuit is electrically connected to the antenna.

As described above, the coaxial connector 1 with a switch comprises: the ceiled cylindrical insulation body 10 which integrally has the pedestal portion 11 on a bottom side, and in which the plug pin insertion hole 14 is formed in a center area of the ceiling face, the plug pin insertion hole enabling the plug pin 100 of the counter connector to be insertable and extractable along the cylinder axis in a center area inside the cylinder; the external-conductor shell 30 having the cylindrical shell body 31 which is fitted to the outside of the cylinder of the insulation body 10, and the solder connecting portions 32*a*, 32*b* which elongate integrally from the shell body 31 along the bottom face of the insulation body 10; the stationary connect member 40 for a switch having the stationary contact portion 41 which is housed and fixed to a position inside the cylinder of the insulation body 10 and deviated from the plug pin insertion region 15, and the solder connecting portion 42 which elongates integrally from the stationary contact portion 41 along the bottom face of the insulation body 10; and a movable connect member 50 having the plate-spring like movable contact piece portion 51 configured by a thin metal plate, and the solder connecting portion 55 which elongates integrally from the movable contact piece portion 51 along the bottom face of the insulation body 10, the movable contact piece portion being housed in a cantilevered manner inside the cylinder of the insulation body 10 and around the plug pin insertion region 15 so that the plate width direction is in parallel with the direction of insertion and extraction of the plug pin, the free side end portion 54*b* laterally passing a part of the plug pin insertion region 15 to elongate to the stationary contact portion 41, and having the plug pin contact portion 57 in the same plane as the movable contact portion 56 which is elastically contacted with the stationary contact portion 41 by a spring force, and is configured so that, in accordance with fitting with the counter connector, the plug pin 100 is elastically contacted with the plug pin contact portion 57, and the movable contact piece portion 51 is displaced in a direction substantially perpendicular to the direction of insertion and extraction of the plug pin against the spring force, whereby the movable contact portion 56 is separated from the stationary contact portion 41.

The coaxial connector 1 with a switch is configured only by the insulation body 10, the external-conductor shell 30, and the stationary connect member 40 and the movable connect member 50 for a switch. Namely, the connector is configured by the four components, or the components the number of which is minimum among coaxial connectors with a switch of this kind. Therefore, the component cost and assembly cost of the coaxial connector 1 with a switch can be reduced, and at the same time the structure can be simplified.

The movable contact piece portion 51 is displaced in a direction substantially perpendicular to the direction of insertion and extraction of the plug pin, and the displacement distance is decided only by the outer diameter of the plug pin 100, and the distance between the plug pin contact portion 57 (contact face) and the axis of the plug pin 100, and is not changed by the insertion stroke of the plug pin 100. Therefore, stress acting on the movable contact piece portion 51, and the contact load of the plug pin contact portion 57 are constant, whereby the electrical connection state is stabilized, and the contact reliability is improved. When the coaxial connector 1 with a switch is used in, for example, a portable telephone as in the embodiment, a measurement environment of excellent high-frequency characteristics is obtained.

The plate-spring like movable contact piece portion 51 configured by a thin metal plate is housed around the plug pin insertion region 15 in a cantilevered manner inside the cylinder of the insulation body 10 so that the plate width direction is in parallel with the direction of insertion and extraction of the plug pin. In order to obtain adequate spring characteristics, the shape of the movable contact piece portion 51 is changed, or the length of the spring is changed, and, in order to disperse stress, a bending portion is added or eliminated, or a bending radius is changed. These countermeasures can be effectively realized simply by increasing or decreasing the sectional area of the movable contact piece portion 51 in terms of space, and in a range where the space is increased or decreased in a reduced degree. Therefore, the life property and contact reliability of the movable contact piece portion 51 can be improved, and the coaxial connector 1 with a switch can be further miniaturized.

In the movable contact piece portion 51, the plug pin contact portion 57 and the movable contact portion 56 can be set in the free side end portion, simply by bending a rectangular thin metal plate in the length direction to be formed into a plate-spring like shape. Therefore, the shape of the movable connect member 50 is simplified, and fine processing of the components can be easily conducted. The component cost and assembly cost of the coaxial connector 1 with a switch can be further reduced.

The plug pin contact portion 57 can elongate to the plug pin insertion region 15 without passing below the plug pin insertion region 15. Therefore, even a space the height of which is equal to the insertion stroke of the plug pin 100 can accommodate the movable contact piece portion 51. The coaxial connector 1 with a switch can be more low-profiled.

In the coaxial connector 1 with a switch, the plug pin leading portion 59 which is curved toward the outside of the plug pin insertion region 15 is formed in a plug pin insertion side end of the plug pin contact portion 57. In the insulation body 10, the plug pin insertion guide walls 17*a*, 18*a* are formed at opposed positions across the plug pin insertion region 15 inside the cylinder, the plug pin insertion guide walls hanging continuously from a hole wall of the plug pin insertion hole 14 in the plug pin insertion direction. When this configuration is employed, the plug pin 100 is inserted with being guided by the plug pin insertion guide walls 17*a*, 18*a* in which a part of a cylinder is D-cut. Therefore, the plug pin 100 is prevented from being inserted obliquely or in a state where the axis is largely eccentric. The plug pin leading portion 59 enables the plug pin 100 to be surely slidingly inserted to the side of the contact face of the plug pin contact portion 57. High contact reliability, and a sure contact changeover operation of the changeover switch 60 are obtained.

Figure 11:
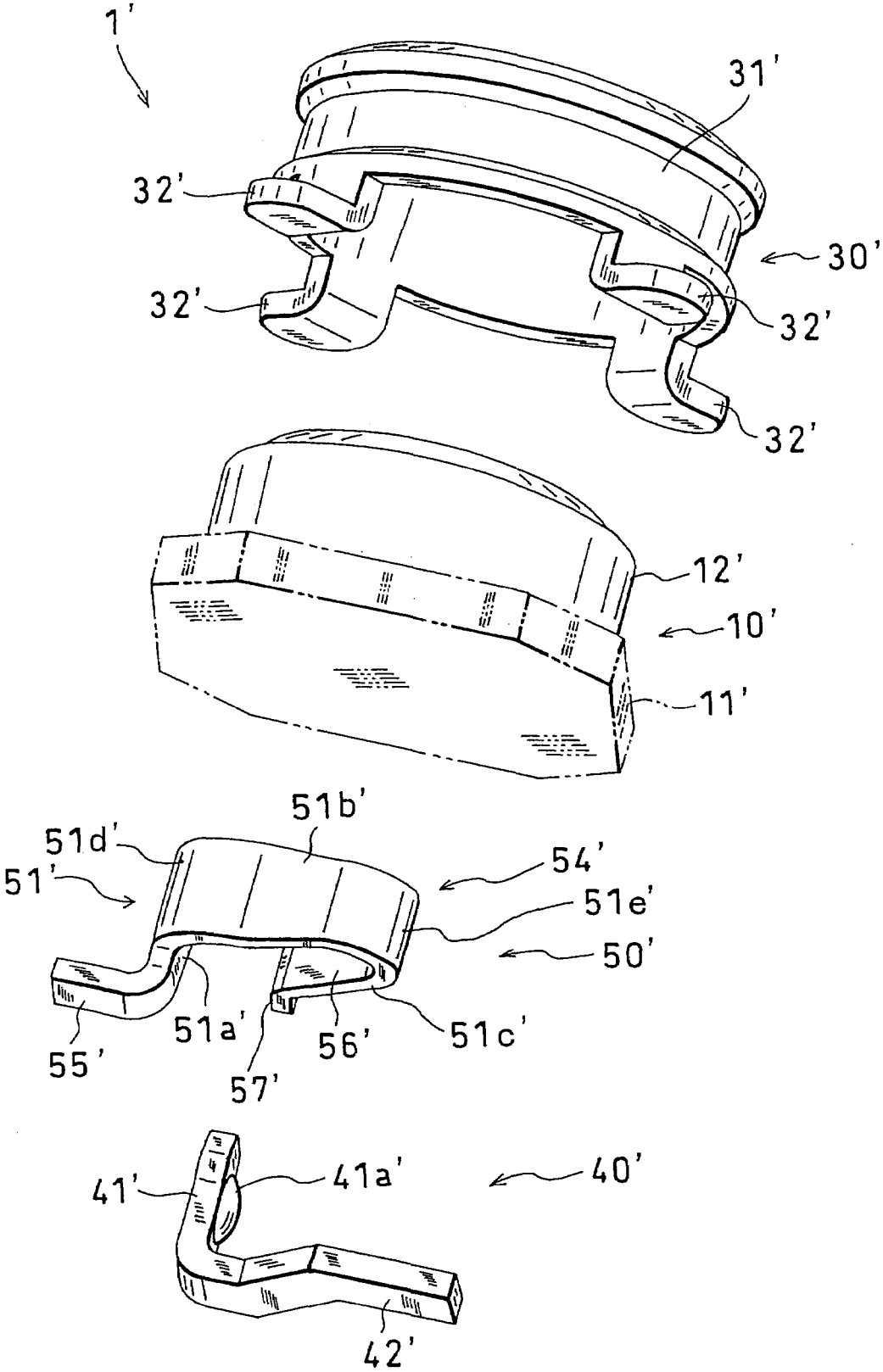
FIG. 11 is an exploded perspective view of a coaxial connector 1' with a switch of a second embodiment.

Next, a second embodiment of the invention will be described with reference to FIGS. 11 to 21. As shown in FIG. 11, a coaxial connector 1' with a switch is configured only by four components of an insulation body 10', an external-conductor shell 30', a stationary connect member 40' for a switch, and a movable connect member 50'.

Next, each of the components will be described.

Figures 12A, 12B, 12C, 12D, 12E:
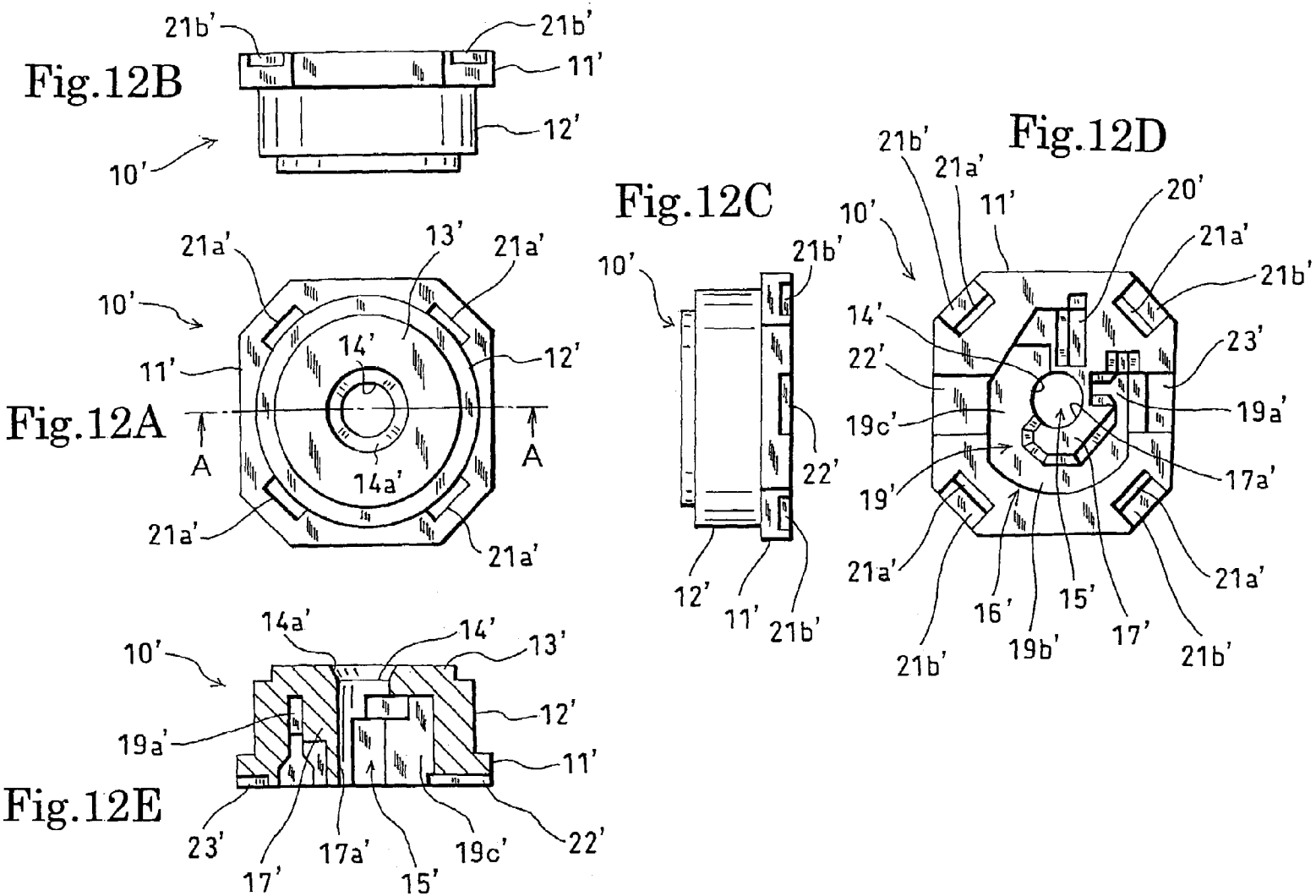
FIG. 12 is a view showing an insulation body 10' of the coaxial connector 1' with a switch of the second embodiment, wherein (a) is a front view (a view of the insulation body 10' seen in a direction of fitting to a counter connector), (b) is a plan view, (c) is a right side sectional view, (d) is a bottom view, and (e) is an A—A sectional view in the front view (a section of the insulation body 10' taken along a plane parallel to a plug pin insertion and extraction direction)

As shown in FIGS. 11 and 12, the insulation body 10' is made of an insulative resin material (for example, "LCP"), and formed into a ceiled cylindrical shape which integrally has a substantially parallelepiped pedestal portion 11' in the bottom side. The pedestal portion 11' is formed into a square plate-like shape. The length of one side of the square shape is approximately equal to a dimension which is obtained by adding the thickness of a thin metal plate forming the external-conductor shell 30' to the outer diameter of a cylindrical body 12', i.e., the outer diameter of the shell body 31' of the external-conductor shell 30'. The body 12' is formed integrally perpendicularly at a concentric position of the upper face of the pedestal portion 11'. Four edges of the pedestal portion 11' which largely project form the body 12' are chamfered. In a center portion of a disk-like body ceiling face portion 13', formed is a circular plug pin insertion hole 14' through which a plug pin 100' (see FIG. 20) of a counter connector is insertable and extractable into a center area inside the body 12' along the axis of the body 12'. Therefore, a thin columnar space which is in a center area inside the body 12', and which is coaxial with the axis of the body serves as a plug pin insertion region 15'. The plug pin insertion hole 14' is formed as a taper hole in which the hole diameter is gradually reduced as further advancing from the outer face of the body ceiling face portion 13' toward the inner face, i.e., in the plug pin insertion direction. The plug pin insertion hole 14' is opened in the inner face of the body ceiling face portion 13' with a diameter which is slightly larger than the diameter of the plug pin 100'. An inverted truncated cone-like hole wall of the plug pin insertion hole 14' is a leading face 14*a*' for insertion of the plug pin 100'.

Figure 17B:
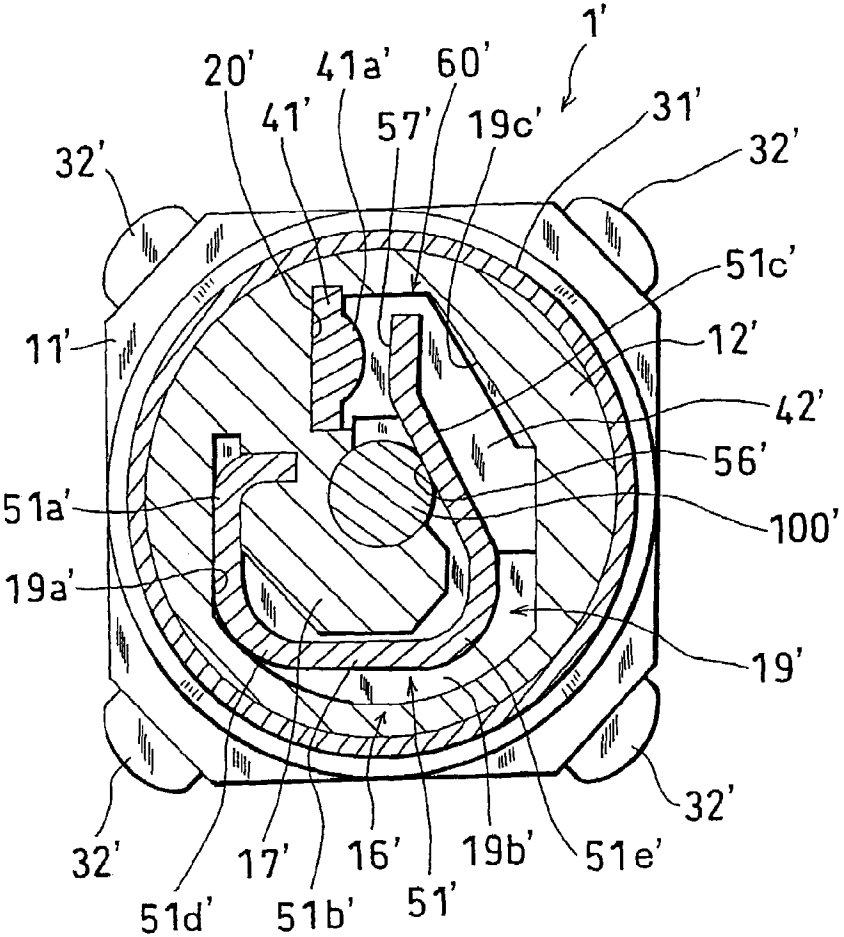
FIG. 17 is a B—B sectional view in the right side sectional view of (c) of FIG. 16 (a section of a body 12' of the coaxial connector 1' with a switch taken along a plane perpendicular to the plug pin insertion and extraction direction), wherein (a) is a sectional view when a plug pin 100' is not inserted, and (b) is a sectional view when the plug pin 100' is inserted.
Figure 17A:
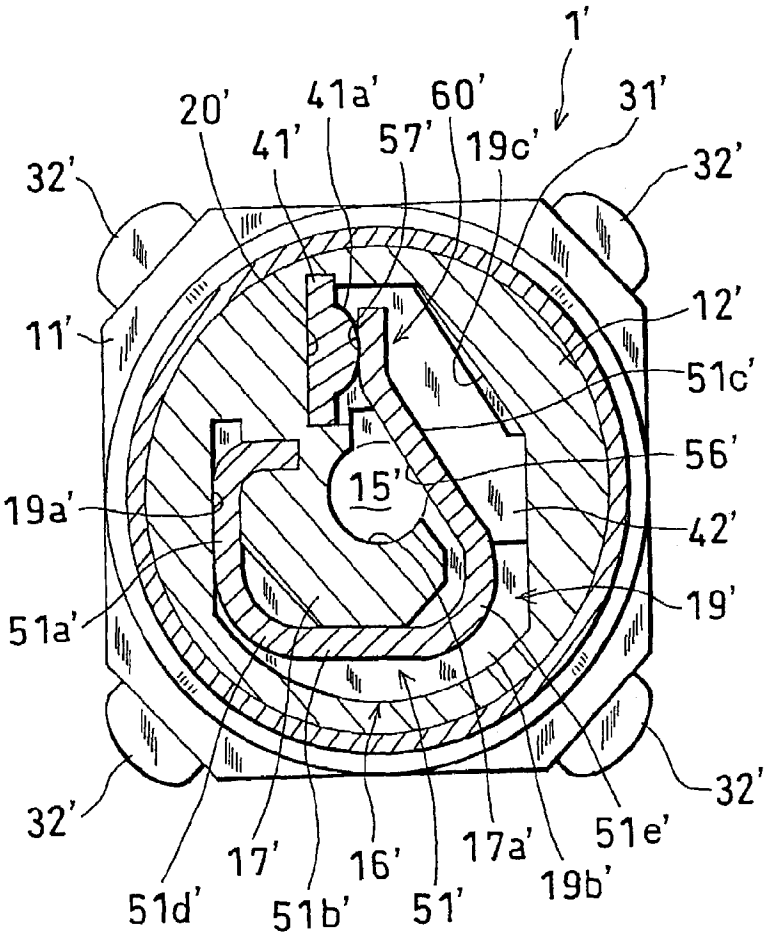
Figure 18:
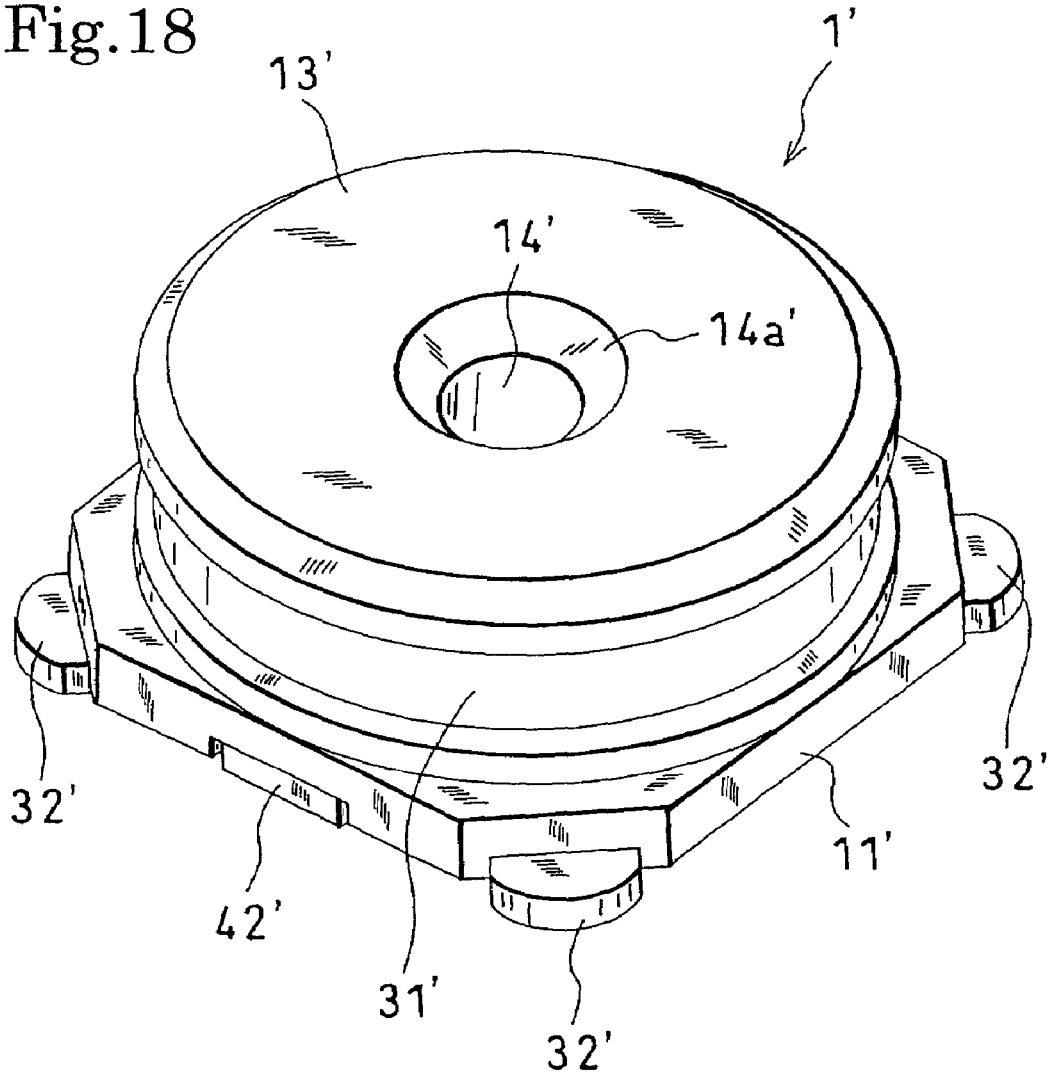
FIG. 18 is an external perspective view showing the coaxial connector 1' with a switch of the second embodiment.
Figure 19:
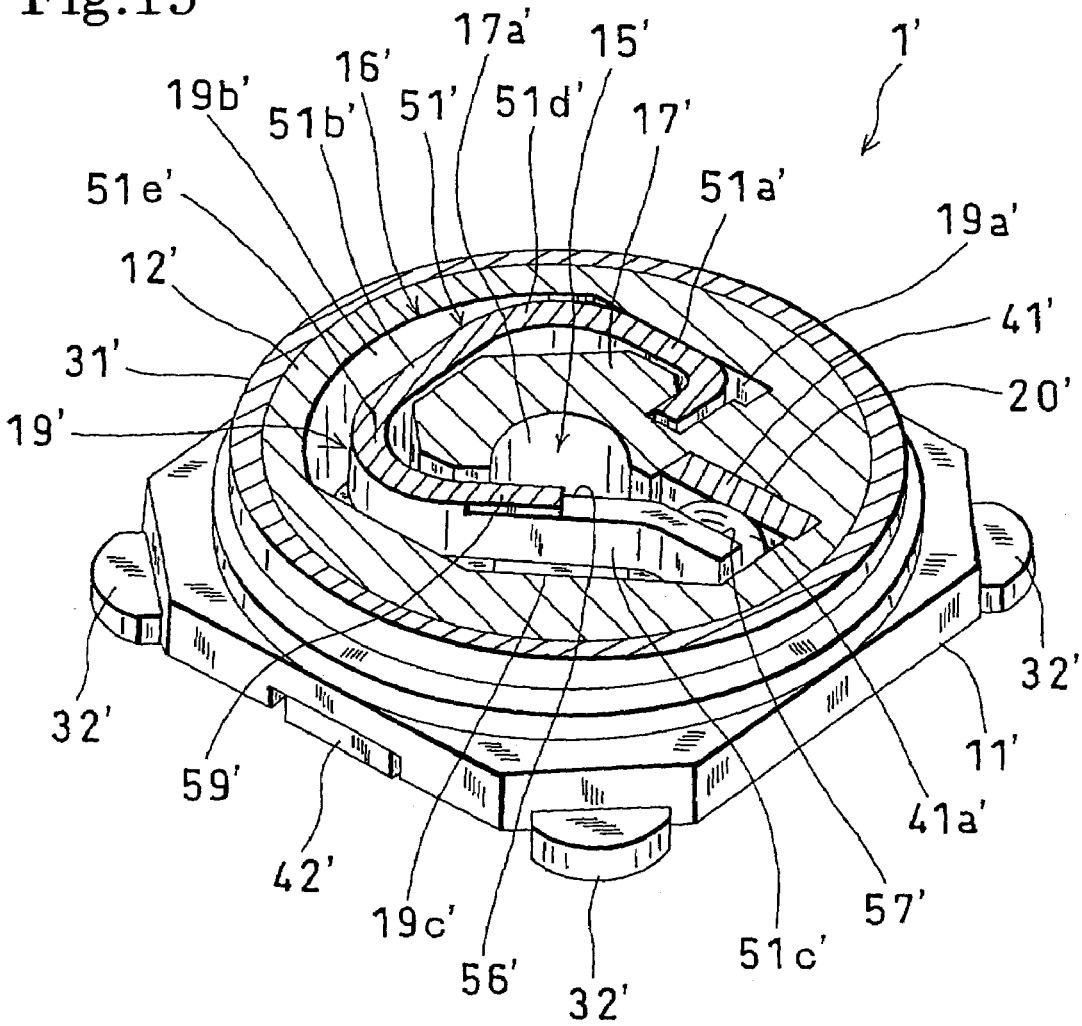
FIG. 19 is a cross-sectional perspective view showing the interior of the coaxial connector 1' with a switch of the second embodiment.

Inside the body 12', as shown in FIG. 17 also, a partition wall 17' which is protruded in a cantilevered state from one place of the inner wall of the body 12' to the center area inside the body 12' including the plug pin insertion region 15' hangs integrally from the body ceiling face portion 13' so as to form a switch housing chamber 16' having a substantially "c"-like section shape around the plug pin insertion region 15'. In the partition wall 17', a portion corresponding to the plug pin insertion region 15' at a tip end portion is cut away by a cylindrical face to, in the center area inside the body 12', form the plug pin insertion region 15', i.e., a thin columnar space which is concentric with the axis of the body 12'. The cylindrical cut away face at the tip end portion of the partition wall 17' surrounding the plug pin insertion region 15' serves as a hole wall of the plug pin insertion hole 14', i.e., a plug pin insertion guide wall 17*a*' which hangs continuously from the leading face 14*a*' in the plug pin insertion direction. As a result, inside the body 12', the switch housing chamber 16' having a substantially "c"-like section shape is formed via the partition wall 17' around the plug pin insertion region 15'. The plug pin insertion region 15' and the switch housing chamber 16' are passed through the pedestal portion 11', and opened in the lower face of the portion, i.e., the bottom face of the insulation body 10'. The switch housing chamber 16' has: a movable contact piece housing groove 19' which occupies an approximately whole area of the chamber, and which has a substantially "c"-like section shape; and a stationary contact portion housing groove 20' which is formed continuously at one end of the movable contact piece housing groove 19'.

The movable contact piece housing groove 19' has: a staring end portion 19*a*' which is formed to have a width that is substantially equal to the thickness of the thin metal plate forming the movable connect member 50', and which is narrowest; an intermediate portion 19*b*' which is formed continuously to the staring end portion 19*a*', and the width of which is gradually increased; and a terminal end portion 19*c*' which is formed continuously to the intermediate portion 19*b*', and which has the largest width. The stationary contact portion housing groove 20' is formed continuously to the terminal end portion 19*c*'. The movable contact piece housing groove 19' is formed around the plug pin insertion region 15' and at an eccentric position so that a part of the terminal end portion 19*c*' overlaps with a part of the plug pin insertion region 15'. The partition wall 17' is broken in the overlapping area of the plug pin insertion region 15' and the movable contact piece housing groove 19', and the region and the groove communicate with each other.

In the insulation body 10', formed are solder connecting portion through holes 21*a*' and solder connecting portion housing grooves 21*b*' of the external-conductor shell 30', a solder connecting portion housing groove 22' of the stationary connect member 40', and a solder connecting portion housing groove 23' of the movable connect member 50' The solder connecting portion through holes 21*a*' of the external-conductor shell 30' are configured by through holes which vertically passes the pedestal portion 11', and formed respectively in parallel with chamfered end faces of the pedestal portion 11', and at four equally spaced places around the body 12'. The other solder connecting portion housing grooves 21*b*', 22', 23' are formed as recesses in the lower face of the pedestal portion 11', i.e., the bottom face of the insulation body 10'. The solder connecting portion housing grooves 21*b*' of the external-conductor shell 30' are formed respectively between lower end openings of the solder connecting portion through holes 21*a*' and chamfered ends of the pedestal portion 11'. The solder connecting portion housing groove 22' of the stationary connect member 40' is formed between an lower end opening of the terminal end portion 19*c*' of the movable contact piece housing groove 19' and a middle portion of one side end of the pedestal portion 11' which is on the outer side of the opening. The solder connecting portion housing groove 23' of the movable connect member 50' is formed between an lower end opening of the starting end portion 19*a*' of the movable contact piece housing groove 19' and a middle portion of one side end of the pedestal portion 11' which is on the outer side of the opening.

Figure 13B:
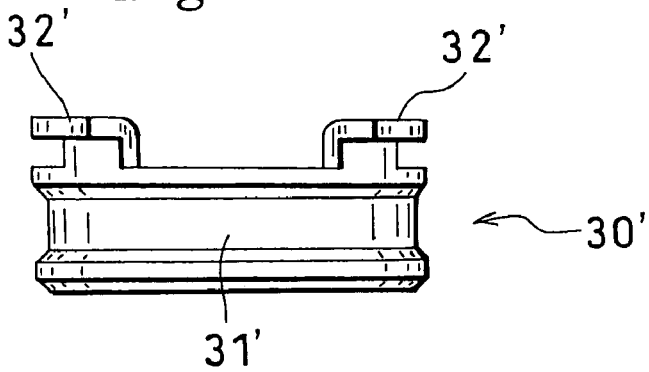
FIG. 13 is a view showing an external-conductor shell 30' of the coaxial connector 1' with a switch of the second embodiment, wherein (a) is a front view (a view of the external-conductor shell 30' seen in the direction of fitting to the counter connector), (b) is a plan view, and (c) is a right side sectional view.
Figure 13A:
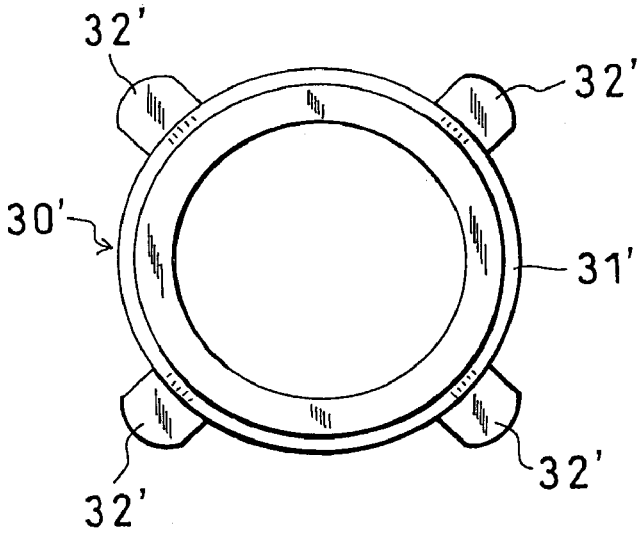
Figure 13C:
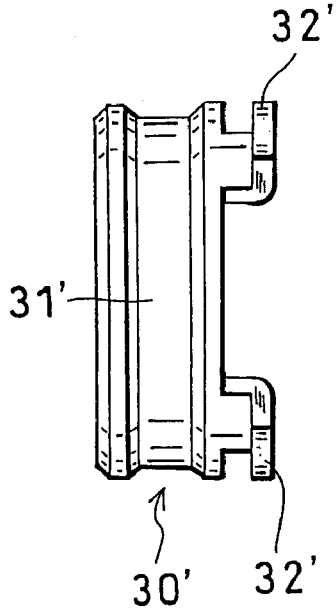

As shown in FIGS. 11, 13, and 17, the external-conductor shell 30' is configured by a conductive metal plate (for example, "copper alloy"), and has: a cylindrical shell body 31' which is fitted to the outside of the body 12'; and four L-like solder connecting portions 32' which elongate integrally from the lower end edge of the shell body 31' along the lower face of the pedestal portion 11', i.e., the bottom face of the insulation body 10'. Before the external-conductor shell 30' is installed to the insulation body 10', the solder connecting portions 32' elongate downward integrally from the lower end edge of the shell body 31' in an extended state. During an installing process, the solder connecting portions can be passed through from the upper face of the pedestal portion 11' to the lower face via the solder connecting portion through holes 21*a*', respectively. After the passing-through process, the solder connecting portions 32' protruded toward the lower face of the pedestal portion 11' are bent toward a radial outside of the body 12', whereby the horizontal portions that are more forward than the bent portions of the L-shaped solder connecting portions 32' are fitted into the solder connecting portion housing grooves 21*b*' in which the base portions are formed in the chamfered portions of the bottom face of the insulation body 10', and the tip end portions are caused to elongate the bottom face of the insulation body 10' in a state where the tip end portions are protruded into the chamfered portions of the bottom face of the insulation body 10'. The solder connecting portion housing grooves 21*b*' are formed so that their depths are slightly shallower than the thicknesses of the solder connecting portions 32', and the lower surfaces of the horizontal portions which are more forward than the bent portions of the L-shaped solder connecting portions 32' are exposed from the bottom face of the insulation body 10' in a slightly protruded state.

Figure 14B:
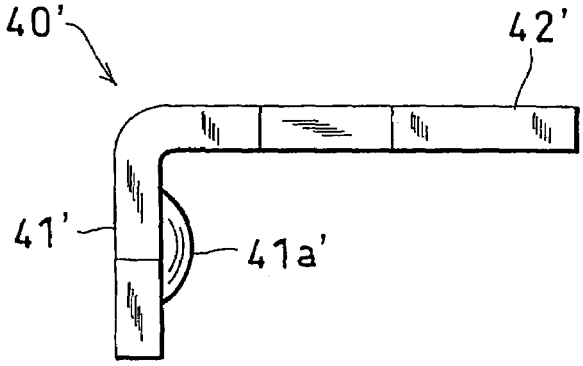
FIG. 14 is a view showing a stationary connect member 40' of the coaxial connector 1' with a switch of the second embodiment, wherein (a) is a front view (a view of the stationary connect member 40' seen in the direction of fitting to the counter connector), (b) is a plan view, and (c) is a right side sectional view.
Figure 14A:
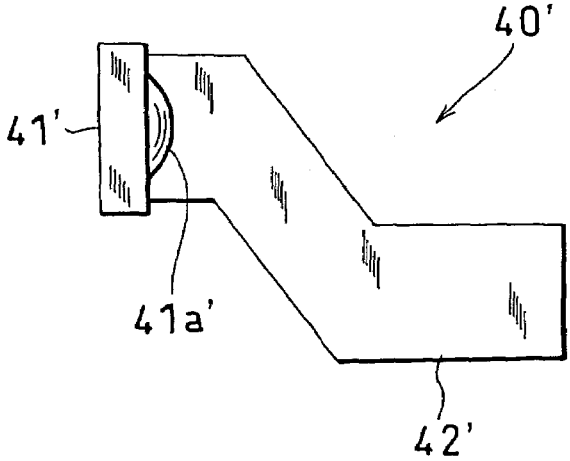
Figure 14C:
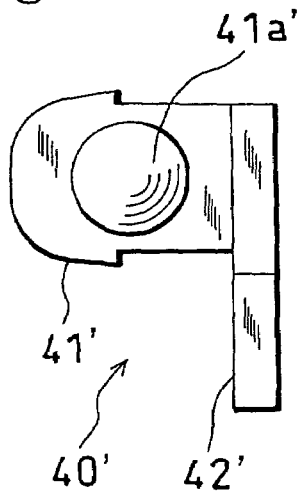

As shown in FIGS. 11, 14, and 17, the stationary connect member 40' is produced by stamping out a predetermined shape from a conductive metal plate (for example, "copper alloy"), and then bending one end at right angle. The stationary connect member 40' has: a stationary contact portion 41' which is fitted into the stationary contact portion housing groove 20' of the insulation body 10', and which is housed and fixed at a position deviated from the plug pin insertion region 15' in the switch housing chamber 16'; and a solder connecting portion 42' which elongates integrally perpendicularly from the lower end of the stationary contact portion 41' along the bottom face of the insulation body 10'. The stationary contact portion housing groove 20' houses and fixes the stationary contact portion 41' in a state where it is embedded in a terminal end wall face of the terminal end portion 19*c*' of the movable contact piece housing groove 19', and the terminal end wall face of the terminal end portion 19*c*' of the movable contact piece housing groove 19' is configured by a metal surface, thereby allowing the metal surface of the stationary contact portion 41' to be exposed in a flush state from the terminal end wall face. A stationary contact 41*a*' is inflatingly formed in a spherical manner on the metal surface of the stationary contact portion 41' which is exposed in a flush state from the terminal end wall face of the terminal end portion 19*c*' of the movable contact piece housing groove 19'. Also the solder connecting portion housing groove 22' in the bottom face of the insulation body 10' to which the solder connecting portion 42' of the stationary connect member 40' is fitted is formed so that its depth is slightly shallower than the thickness of the solder connecting portion 42', and the lower face of the solder connecting portion 42' is exposed from the bottom face of the insulation body 10' in a slightly protruded state, in the same plane as the lower surfaces of the solder connecting portions 32' of the external-conductor shell 30'.

Figure 15B:
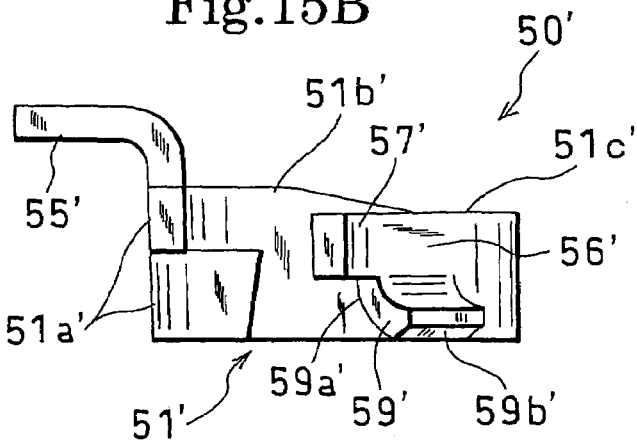
FIG. 15 is a view showing a movable connect member 50' of the coaxial connector 1' with a switch of the second embodiment, wherein (a) is a front view (a view of the movable connect member 50' seen in the direction of fitting to the counter connector), (b) is a plan view, and (c) is a right side sectional view.
Figure 15A:
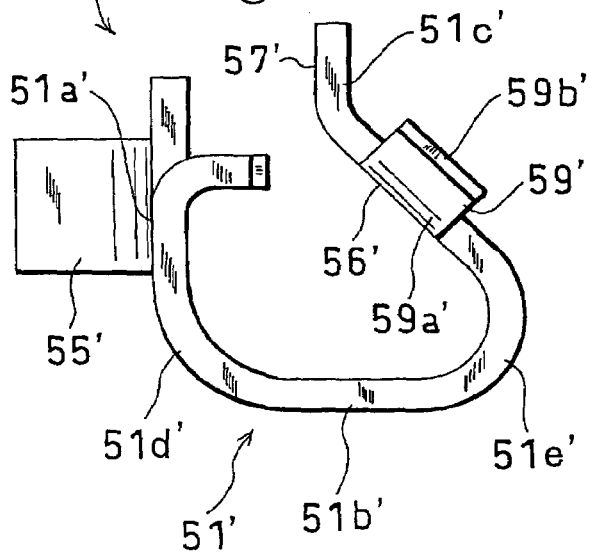
Figure 15C:
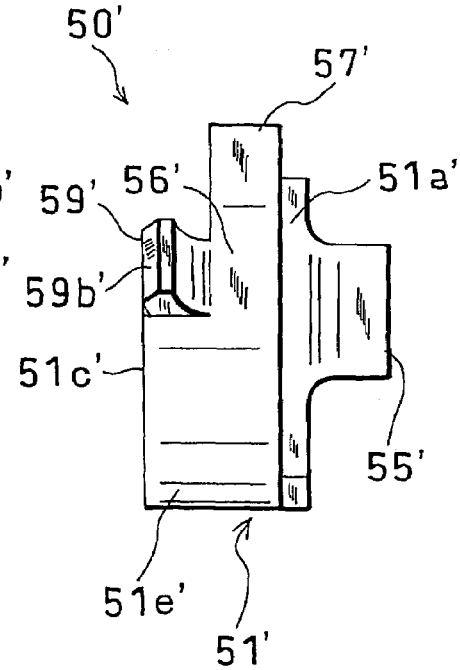
Figure 16B:
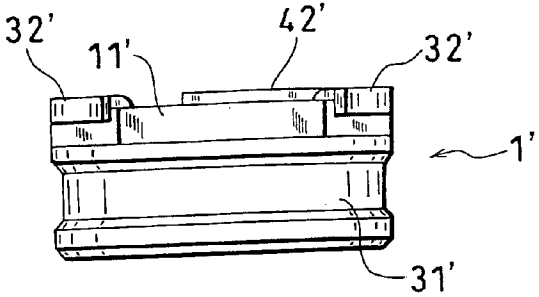
FIG. 16 is a view showing the coaxial connector 1' with a switch of the second embodiment, wherein (a) is a front view (a view of the coaxial connector 11 with a switch seen in the direction of fitting to the counter connector), (b) is a plan view, (c) is a right side sectional view, and (d) is a bottom view.
Figure 16A:
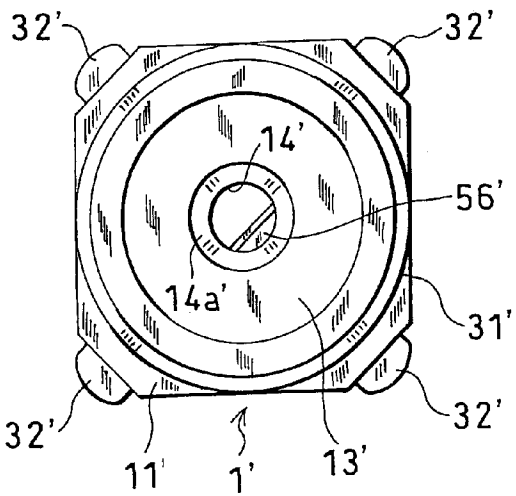
Figure 16C:
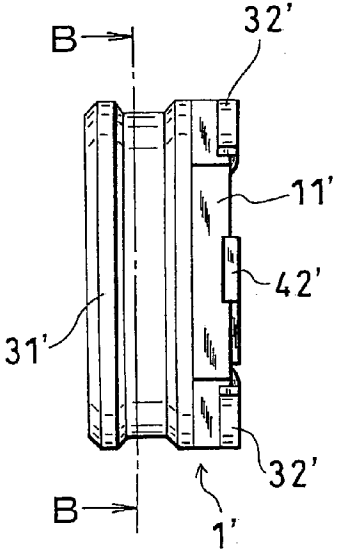
Figure 16D:
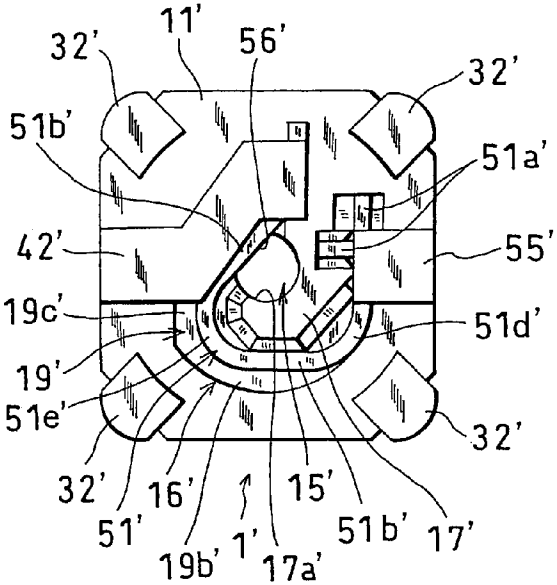

As shown in FIGS. 11, 15, and 17, the movable connect member 50' is produced by stamping out a predetermined shape from a conductive thin metal plate (for example, "copper alloy") before bending it, and has: a movable contact piece portion 51' which is a plate spring to be housed in the movable contact piece housing groove 19' of the insulation body 10'; and a solder connecting portion 55' which elongates integrally perpendicularly from the lower end of a fixed side portion 51*a*' of the movable contact piece portion 51' along the bottom face of the insulation body 10'. The movable contact piece portion 51' is formed by bending a slender thin metal plate having a rectangular shape in the longitudinal direction into a substantially. "c"-like section shape so that circumferential positions of all portions ranging from the fixed side end portion to the free side end portion are different from one another. The movable contact piece portion 51' has: the fixed side portion 51*a*' which is fitted and fixed to the staring end portion 19*a*' of the movable contact piece housing groove 19'; an arm portion 51*b*' which is fitted into the intermediate portion 19*b*' of the movable contact piece housing groove 19'; a free side portion 51*c*' which is fitted into the terminal end portion 19*c*' of the movable contact piece housing groove 19'; a first bent portion 51*d*' which connects the fixed side portion 51*a*' and the arm portion 51*b*' together; and a second bent portion 51*e*' which connects the arm portion 51*b*' and the free side portion 51*c*' together. The stationary contact piece portion is formed to be housed around the plug pin insertion region 15' in a cantilevered state by the movable contact piece housing groove 19' so that the plate width direction is parallel to the direction of insertion and extraction of the plug pin. When the movable contact piece portion 51' is housed in the movable contact piece housing groove 19', an end portion of the free side portion 51*c*' butts against the stationary contact 41*a*' of the stationary contact portion 41' by spring forces of the portions 51*d*', 51*b*', 51*e*', 51*b*' which are more forward than the fixed side portion 51*a*'. In an noninsertion state of the plug pin 100' where an intermediate portion of the free side portion 51*c*' passes the overlapping area of the plug pin insertion region 15' and the terminal end portion 19*c*' of the movable contact piece housing groove 19', and in an insertion state of the plug pin 100' where the intermediate portion of the free side portion 51*c*' passes the outside of the plug pin insertion region 15', and an end portion of the free side portion 51*c*' is separated from the stationary contact 41*a*' of the stationary contact portion 41', the portions 51*d*', 51*b*', 51*e*', 51*b*' which are more forward than the fixed side portion 51*a*' are elastically displaceable in a range from the intermediate portion 19*b*' to the terminal end portion 19*c*' of the movable contact piece housing grooved 19' in a direction substantially perpendicular to the direction of insertion and extraction of the plug pin. An end portion of the free side portion 51$c'$ which is elastically contacted with the stationary contact 41$a'$ of the stationary contact portion 41' serves as a movable contact portion 56'. The intermediate portion of the free side portion 51$c'$ which passes the overlapping area of the plug pin insertion region 15' and the terminal end portion 19$c'$ of the movable contact piece housing groove 19' serves as a plug pin contact portion 57'. Namely, the movable contact portion 56' and the plug pin contact portion 57' are disposed in the same plane which is continuous in the length direction of the free side portion 51$c'$ of the movable contact piece portion 51'.

The movable contact piece portion 51' is designed in the following manner so that stress is received distributedly by the two or first and second bent portions 51$d'$ and 51$e'$. The first and second bent portions 51$d'$ and 51$e'$ are formed so that the bending angle of the free side portion 51$c'$ with respect to the arm portion 51$b'$ is smaller than that of the arm portion 51$b'$ with respect to the fixed side portion 51$a'$ (for example, the former is an acute angle, and the latter is an obtuse angle). The free side portion 51$c'$ is elastically displaced with setting the second bent portion 51$e'$ as the fulcrum while the arm portion 51$b'$ and the free side portion 51$c'$ are integrally elastically displaced with setting the first bent portion 51$d'$ as the fulcrum.

Figure 21:
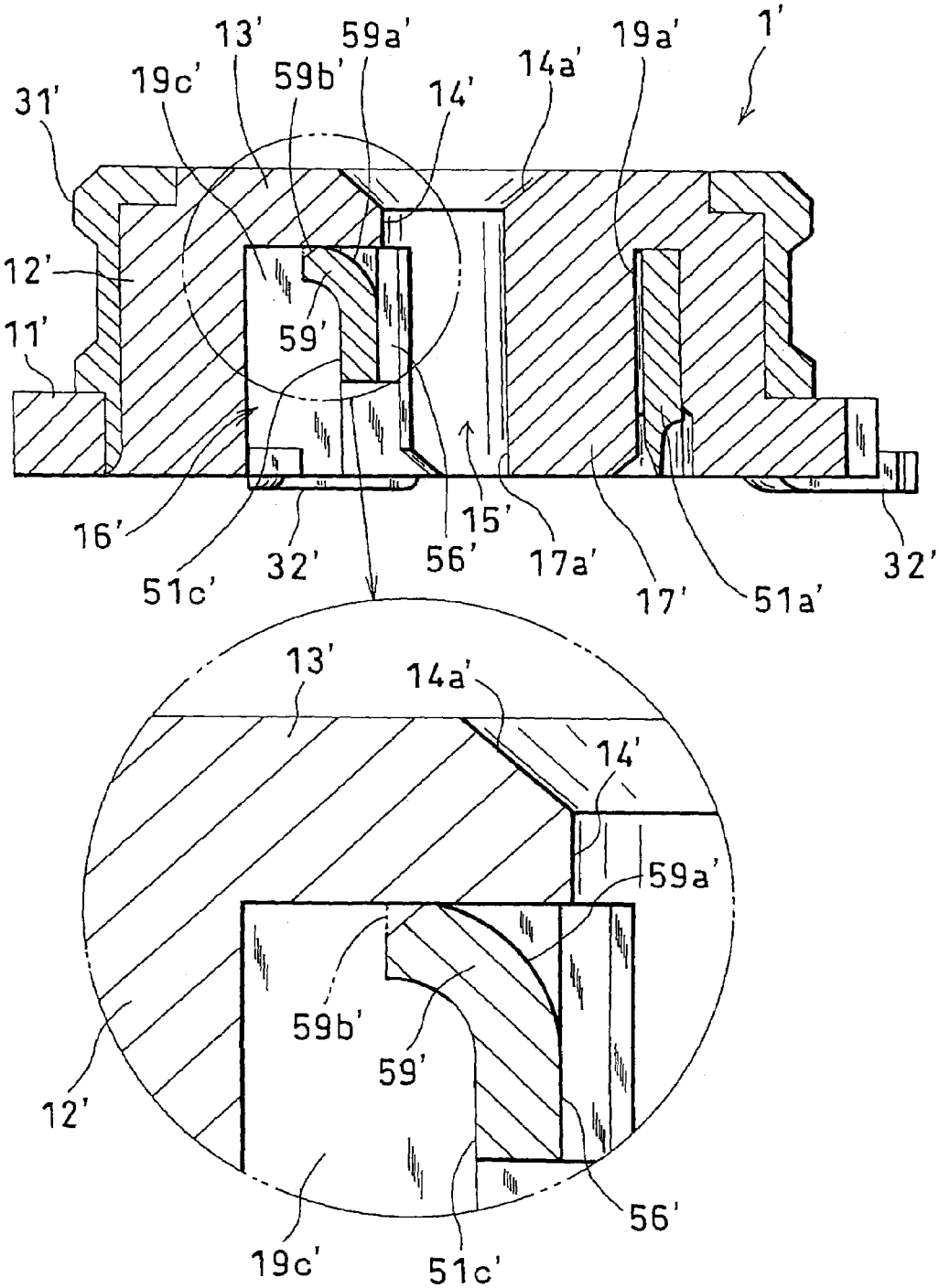
FIG. 21 is a sectional view showing the coaxial connector 1' with a switch of the second embodiment.

In the intermediate portion of the free side portion 51$c'$ of the movable contact piece portion 51', i.e., the upper end portion of the plug pin contact portion 57' serving as a plug pin insertion side end, a plug pin leading portion 59' which is curved toward the outside of the plug pin insertion region 15' is continuously formed in order to lead the plug pin 100' toward a plug pin contact face of the plug pin contact portion 57'. As shown in FIG. 21 also, the plug pin leading portion 59' is formed so that the upper end of a plug pin leading face 59$a'$ is in sliding contact with the body ceiling face portion 13', and an edge formed by the plug pin leading face 59$a'$ and the tip end face is provided with a chamfer 59$b'$.

The solder connecting portion 55' of the movable connect member 50' elongates perpendicularly integrally from the lower end of the fixed side portion 51$a'$ of the movable contact piece portion 51' along the bottom face of the insulation body 10'. Also the solder connecting portion housing groove 23' of the bottom face of the insulation body 10' into which the solder connecting portion 55' is fitted is formed so that its depth is slightly shallower than the thickness of the solder connecting portion 55', and the lower face of the solder connecting portion 55' is exposed from the bottom face of the insulation body 10' in a slightly protruded state, in the same plane as the lower surfaces of the solder connecting portions 32' of the external-conductor shell 30' and the solder connecting portion 42' of the stationary connect member 40'.

Next, the assembling of the coaxial connector 1' with a switch will be described. Since the coaxial connector 1' with a switch is configured only by the four components of the insulation body 10', the external-conductor shell 30', the stationary connect member 40', and the movable connect member 50', the state shown in FIGS. 16 to 20 can be assembled by three steps, or a step of installing the external-conductor shell 30' to the insulation body 10', that of installing the stationary connect member 40' to the insulation body 10', and that of installing the movable connect member 50' to the insulation body 10'.

The installation of the external-conductor shell 30' to the insulation body 10' can be conducted in the following manner. The shell body 31' is fitted to the outside of the body 12' from the upper side while the solder connecting portions 32' in an extended state are passed through the solder connecting portion through holes 21$a'$ from the above of the pedestal portion 11'. Thereafter, the solder connecting portions 32' which are protruded toward the lower face of the pedestal portion 11' are bent toward a radial outside of the body 12'. The horizontal portions that are more forward than the bent portions of the L-shaped solder connecting portions 32' are fitted into the solder connecting portion housing grooves 21$b'$ in which the base portions are formed in the chamfered portions of the bottom face of the insulation body 10', and the tip end portions elongate the bottom face of the insulation body 10' in a state where the tip end portions are protruded into the chamfered portions of the bottom face of the insulation body 10'.

The installation of the stationary connect member 40' to the insulation body 10' can be conducted in the following manner. The stationary contact portion 41' is pressingly fixed from the side of the bottom of the insulation body 10' to the stationary contact portion housing groove 20' which is formed continuously to the terminal end portion 19$c'$ of the movable contact piece housing groove 19' of the insulation body 10'. The solder connecting portion 42' is fitted into the solder connecting portion housing groove 22' formed in the bottom face of the insulation body 10'.

The installation of the movable connect member 50' to the insulation body 10' can be conducted in the following manner. The movable contact piece portion 51' is fitted from the side of the bottom of the insulation body 10', into the movable contact piece housing groove 19' of the insulation body 10' so that the plate width direction is parallel to the direction of insertion and extraction of the plug pin. The solder connecting portion 55' is fitted into the solder connecting portion housing groove 23' formed in the bottom face of the insulation body 10'.

With respect to the sequence of the three steps, the step of installing the stationary connect member 40' is conducted after that of installing the movable connect member 50' to the insulation body 10'. Therefore, the solder connecting portion 42' of the stationary connect member 40' does not interfere with the operation of fitting the movable contact piece portion 51' of the movable connect member 50' into the movable contact piece housing groove 19'. The step of installing the external-conductor shell 30' to the insulation body 10' may be conducted either before or after the steps of installing the movable connect member 50' and the stationary connect member 40'. The installation of the external-conductor shell 30' to the insulation body 10' may be conducted by insert molding in place of the above-mentioned fitting process.

When the coaxial connector 1' with a switch is assembled as a result of the three steps, as shown in FIGS. 16 to 20, the shell body 31' of the external-conductor shell 30' is fitted to the outside of the body 12' of the insulation body 10'. A normally closed changeover switch 60' configured by: the stationary contact portion 41' of the stationary connect member 40' housed in the stationary contact portion housing groove 20'; and the movable contact piece portion 51' of the movable connect member 50' housed in the movable contact piece housing groove 19' is housed in the switch housing chamber 16' of the body 12' communicating with the outside of the insulation body 10' via the plug pin insertion hole 14' formed in the center area of the ceiling face portion 13' of the insulation body 10'. The solder connecting portions 32' of the external-conductor shell 30', the solder connecting portion 42' of the stationary connect member 40', and the solder connecting portion 55' of the movable connect member 50' are exposed from the lower face of the pedestal portion 11' of the insulation body 10', i.e., the bottom face of the insulation body 10', in a noncontact state where the solder connecting portions are separated from each other, in a state where the lower surfaces of the solder connecting portions are slightly protruded from the bottom face of the insulation body 10', and in one plane which is parallel to the bottom face of the insulation body 10'. As a result, the surface mount type coaxial connector 1' with a switch incorporating the normally closed changeover switch 60' is obtained.

Since the stationary contact portion 41' of the changeover switch 60' is housed in the stationary contact portion housing groove 20', the metal surface of the stationary contact portion 41' on which the stationary contact 41*a'* is inflatingly formed in a spherical manner is exposed in a flush state from the terminal end wall face of the terminal end portion 19*c'* of the movable contact piece housing groove 19', and the stationary contact 41*a'* is protruded from the metal surface to the terminal end portion 19*c'* of the movable contact piece housing groove 19'. By contrast, since the movable contact piece portion 51' of the changeover switch 60' is housed in the movable contact piece housing groove 19', the fixed side portion 51*a'* of the movable contact piece portion 51' is fitted and fixed to the staring end portion 19*a'* of the movable contact piece housing groove 19', the portions 51*d'*, 51*b'*, 51*e'*, 51*b'* which are more forward than the fixed side portion 51*a'* are fitted into the range from the intermediate portion 19*b'* to the terminal end portion 19*c'* of the movable contact piece housing groove 19' and supported around the plug pin insertion region 15' in a cantilevered state, and in a state where the plate width direction is parallel to the direction of insertion and extraction of the plug pin, the end portion of the free side portion 51*c'* of the movable contact piece portion 51' butts against the stationary contact 41*a'* of the stationary contact portion 41' by the spring forces of the portions 51*d'*, 51*b'*, 51*e'*, 51*b'* which are more forward than the fixed side portion 51*a'*, and the intermediate portion of the free side portion 51*c'* passes the overlapping area of the plug pin insertion region 15' and the terminal end portion 19*c'* of the movable contact piece housing groove 19'. The stationary contact portion 41' and the movable contact piece portion 51' which are formed as described above enable the normally closed changeover switch 60' to be configured and incorporated in the switch housing chamber 16' of the body 12'.

The coaxial connector 1' with a switch which is obtained as described above is surface mounted on a printed circuit board (not shown) so that the bottom face of the insulation body 10' is joined to a mounting surface of the printed circuit board on which the connector is to be mounted, whereby the solder connecting portions 32' of the external-conductor shell 30', the solder connecting portion 42' of the stationary connect member 40', and the solder connecting portion 55' of the movable connect member 50' which are exposed from the bottom face of the insulation body 10' are soldered to corresponding patterns of the printed circuit board. In the embodiment, the coaxial connector 1' with a switch is surface mounted on a printed circuit board of a portable telephone so that the solder connecting portions 32' of the external-conductor shell 30' are electrically connected to a ground pattern of the printed circuit board, the solder connecting portion 42' of the stationary connect member 40' is electrically connected to an antenna of the portable telephone via a pattern of the printed circuit board, the solder connecting portion 55' of the movable connect member 50' is electrically connected to a high-frequency circuit of the portable telephone, and the changeover switch 60' is connected between the high-frequency circuit of the portable telephone and the antenna. Next, the function of the coaxial connector 1' with a switch of the embodiment will be described with reference to FIGS. 17 and 20. In this case, the counter connector is a measurement probe connected to a measurement apparatus which checks electrical characteristics of a high-frequency circuit. In the probe, as well known in the art, the plug pin 100' is disposed at the center of a cylindrical external conductor which is not shown.

In the coaxial connector 1° with a switch, as shown (a) of FIG. 17, before the counter connector is fitted and the plug pin 100' is inserted, the movable contact portion 56' of the movable connect member 50' is elastically contacted with the stationary contact 41*a'* of the stationary connect member 40' in a state where the plug pin contact portion 57' of the movable connect member 50' is positioned in the overlapping area of the plug pin insertion region 15' and the terminal end portion 19*c'* of the movable contact piece housing groove 19', by the spring forces of the portions 51*d'*, 51*b'*, 51*e'*, 51*c'* which are more forward than the fixed side portion 51*a'* of the movable contact piece portion 51', and the high-frequency circuit and the antenna are electrically connected to each other via the connect members 50', 40' and the patterns of the printed circuit board.

Figure 20:
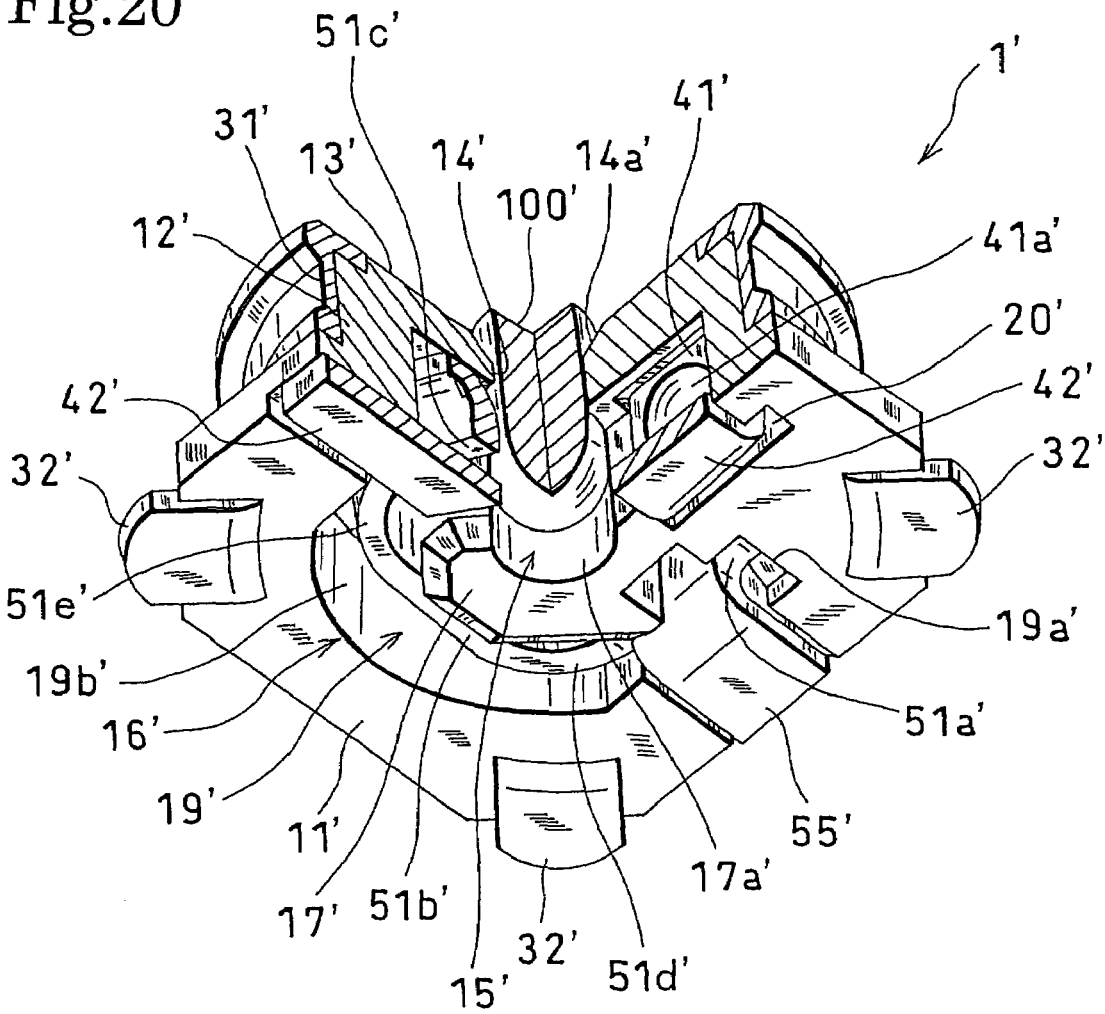
FIG. 20 is a perspective view showing the interior of the coaxial connector 1' with a switch of the second embodiment in a state where the plug pin 100' is inserted.

When the counter connector is fitted to the coaxial connector 1' with a switch, as shown (b) of FIG. 17 and FIG. 20, the plug pin 100' is guided from the plug pin insertion hole 14' by the plug pin leading face 59*a'* and the plug pin insertion guide wall 17*a'* in accordance with the fitting, and inserted along the axis of the body 12' to the plug pin insertion region 15' in the center area inside the body 12'. During this insertion process, a spherical tip end face of the plug pin 100' is in sliding contact with the one-quarter arc plug pin leading face 59*a'* of the plug pin leading portion 59', and the plug pin contact portion 57' is displaced against the spring force in a direction perpendicular to the direction of insertion and extraction of the plug pin so that the plug pin contact portion 57' is pushed and retracted toward a radial outside of the plug pin insertion region 15' (the plug pin 100'), whereby the plug pin 100' is inserted with being in sliding contact with the plug pin contact face of the plug pin contact portion 57'. As a result, the plug pin contact portion 57' is elastically contacted with the outer side face of the plug pin 100', the movable contact portion 56' which is disposed in the same plane continuous in the length direction to the plug pin contact portion 57', and which is more forward than the plug pin contact portion 57' is separated from the stationary contact 41*a'* of the stationary contact portion 41', and the connection of the high-frequency circuit is switched from the antenna to the measurement apparatus via the plug pin 100'.

The movable contact piece portion 51' is bent into a substantially "c"-like shape, passes the movable contact piece housing groove 19' having a substantially "c"-like section shape, and enters from the one side of the plug pin insertion region 15' to the opposite side. Therefore, the movable contact piece portion has a sufficient spring length. Furthermore, the movable contact piece portion 51' has the first bent portion 51*d'* and the second bent portion 51*e'*, and is designed so that stress is received distributedly by the two bent portions 51*d'*, 51*e'*. Therefore, a large bending moment is not partly produced, the spring characteristics are hardly impaired by repetitive insertion and extraction of the plug pin 100', and the life property against repetitive insertion and extraction of the plug pin 100' can be improved. The plug pin contact portion 57' and the movable contact portion 56' are disposed in the same plane of the free side portion 51*c'* in which the plate width direction of the movable contact piece portion 51' is parallel to the direction of insertion and extraction of the plug pin, and the plug pin contact portion 57' is disposed more forward than the movable contact portion 56'. Therefore, the ratio of the displacement distances of the plug pin contact portion 57' and the movable contact portion 56' is not 1 to 1, and the displacement distance of the movable contact portion 56' is larger than that of the plug pin contact portion 57'. Consequently, it is possible to obtain a sure contact changeover operation of the changeover switch 60'. Conversely, the displacement distance of the movable contact portion 56' which is necessary for the contact changeover operation of the changeover switch 60' can be obtained by the displacement distance of the plug pin contact portion 57' which is smaller than that of the movable contact portion 56'. Consequently, the elastic displacement distances of the portions 51*d'*, 51*b'*, 51*e'*, 51*c'* which are more forward than the fixed side portion 51*a'* of the movable contact piece portion 51' can be reduced. This is effective in improvement of the life property of the movable contact piece portion 51', and also in miniaturization of the coaxial connector 1' with a switch. The movable contact piece portion 51' is formed into a substantially "c"-like section shape so that circumferential positions of all portions 51*a'*, 51*d'*, 51*b'*, 51*e'*, 51*c'* ranging from the fixed side end portion to the free side end portion are different from one another. Therefore, it is possible to eliminate portions which overlap with each other in a radial direction, the axial distance of which is very short, and which easily interfere with each other in high frequencies, in the portions of the movable contact piece portion 51' ranging from the fixed side end portion to the free side end portion. Furthermore, it is possible to eliminate portions which overlap with each other in a radial direction, which partly enter the plug pin insertion region, and which easily interfere with the plug pin 100' in insertion and extraction of the plug pin, in the portions of the movable contact piece portion 51' ranging from the fixed side end portion to the free side end portion, and excluding the free side portion 51*c'*. This is effective also in miniaturization of the coaxial connector 1' with a switch. The edge portion formed by the plug pin leading face 59*a'* of the plug pin leading portion 59' and the tip end face is provided with the chamfer 59*b'*. Therefore, the edge portion formed by the plug pin leading face 59*a'* of the plug pin leading portion 59' and the tip end face can be prevented from being caught by the body ceiling face portion 13', thereby eliminating an operation failure caused by an interference between the movable contact piece portion 51' and the body ceiling face portion 13'. High contact reliability, and a sure contact changeover operation of the switch 60' are obtained.

When the counter connector is disengaged from the coaxial connector 1' with a switch, the plug pin 100' is pulled out from the switch housing chamber 16' of the body 12' of the insulation body 10', the contact between the plug pin contact portion 57' and the plug pin 100' is broken, and, by the spring forces of the portions 51*d'*, 51*b'*, 51*e'*, 51*c'* which are more forward than the fixed side portion 51*a'* of the movable contact piece portion 51', the plug pin contact portion 57' is elastically restored to the overlapping area of the plug pin insertion region 15' and the terminal end portion 19*c'* of the movable contact piece housing groove 19', and the movable contact portion 56' is again elastically contacted by the spring force of the spring portion 54 with the stationary contact 41*a'* of the stationary contact portion 41', whereby the high-frequency circuit is electrically connected to the antenna.

As described above, the coaxial connector 1' with a switch comprises: the ceiled cylindrical insulation body 10' which integrally has the pedestal portion 11' on a bottom side, and in which the plug pin insertion hole 14' is formed in a center area of the ceiling face, the plug pin insertion hole enabling the plug pin 100' of the counter connector to be insertable and extractable along the cylinder axis in a center area inside the cylinder; the external-conductor shell 30' having the cylindrical shell body 31' which is fitted to the outside of the cylinder of the insulation body 101, and the plural solder connecting portions 32' which elongate integrally from the shell body 31' along the bottom face of the insulation body 10'; the stationary connect member 40' for a switch having the stationary contact portion 41' which is housed and fixed to a position inside the cylinder of the insulation body 10' and deviated from the plug pin insertion region 15', and the solder connecting portion 42' which elongates integrally from the stationary contact portion 41' along the bottom face of the insulation body 10'; and a movable connect member 50' having the plate-spring like movable contact piece portion 51' configured by a thin metal plate, and the solder connecting portion 55' which elongates integrally from the movable contact piece portion 51' along the bottom face of the insulation body 10', the movable contact piece portion being housed in a cantilevered manner inside the cylinder of the insulation body 10' and around the plug pin insertion region 15' so that the plate width direction is in parallel with the direction of insertion and extraction of the plug pin, the free side portion 51*c'* laterally passing a part of the plug pin insertion region 15' to elongate to the stationary contact portion 41', and having the plug pin contact portion 57' in the same plane as the movable contact portion 56' which is elastically contacted with the stationary contact portion 41' by a spring force, and is configured so that, in accordance with fitting with the counter connector, the plug pin 100' is elastically contacted with the plug pin contact portion 57', and the movable contact piece portion 51' is displaced in a direction substantially perpendicular to the direction of insertion and extraction of the plug pin against the spring force, whereby the movable contact portion 56' is separated from the stationary contact portion 41'.

The coaxial connector 1' with a switch is configured only by the insulation body 10', the external-conductor shell 30', and the stationary connect member 40' and the movable connect member 50' for a switch. Namely, the connector is configured by the four components, or the components the number of which is minimum among coaxial connectors with a switch of this kind. Therefore, the component cost and assembly cost of the coaxial connector 1' with a switch can be reduced, and at the same time the structure can be simplified.

The movable contact piece portion 51' is displaced in a direction substantially perpendicular to the direction of insertion and extraction of the plug pin, and the displacement distance is decided only by the outer diameter of the plug pin 100', and the distance between the plug pin contact portion 57' (contact face) and the axis of the plug pin 100', and is not changed by the insertion stroke of the plug pin 100'. Therefore, stress acting on the movable contact piece portion 51', and the contact load of the plug pin contact portion 57' are constant, whereby the electrical connection state is stabilized, and the contact reliability is improved. When the coaxial connector 1' with a switch is used in, for example, a portable telephone as in the embodiment, a measurement environment of excellent high-frequency characteristics is obtained.

The plate-spring like movable contact piece portion 51' configured by a thin metal plate is housed around the plug pin insertion region 15' in a cantilevered manner inside the cylinder of the insulation body 10' so that the plate width direction is in parallel with the direction of insertion and extraction of the plug pin. In order to obtain adequate spring characteristics, the shape of the movable contact piece portion 51' is changed, or the length of the spring is changed, and, in order to disperse stress, a bending portion is added or eliminated, or a bending radius is changed. These countermeasures can be effectively realized simply by increasing or decreasing the sectional area of the movable contact piece portion 51' in terms of space, and in a range where the space is increased or decreased in a reduced degree. Therefore, the life property and contact reliability of the movable contact piece portion 51' can be improved, and the coaxial connector 1' with a switch can be further miniaturized.

In the movable contact piece portion 51', the plug pin contact portion 57' and the movable contact portion 56' can be set in the free side portion 51*c'*, simply by bending a rectangular thin metal plate in the length direction to be formed into a plate-spring like shape. Therefore, the shape of the movable connect member 50' is simplified, and fine processing of the components can be easily conducted. The component cost and assembly cost of the coaxial connector 1' with a switch can be further reduced.

The plug pin contact portion 57' can elongate to the plug pin insertion region 15' without passing below the plug pin insertion region 15'. Therefore, even a space the height of which is equal to the insertion stroke of the plug pin 100' can accommodate the movable contact piece portion 51'. The coaxial connector 1' with a switch can be more low-profiled.

In the coaxial connector 1' with a switch, the plug pin leading portion 59' which is curved toward the outside of the plug pin insertion region 15' is formed in a plug pin insertion side end of the plug pin contact portion 57'. In the insulation body 10', the plug pin insertion guide wall 17*a* is formed on side of the outer circumference of the plug pin insertion region 15' inside the cylinder, the plug pin insertion guide walls hanging continuously from a hole wall of the plug pin insertion hole 14' in the plug pin insertion direction. When this configuration is employed, the plug pin 100' is inserted with being guided by the plug pin insertion guide wall 17*a'*. Therefore, the plug pin 100' is prevented from being inserted obliquely or in a state where the axis is largely eccentric. The plug pin leading portion 59' enables the plug pin 100' to be surely slidingly inserted to the side of the contact face of the plug pin contact portion 57'. High contact reliability, and a sure contact changeover operation of the changeover switch 60' are obtained.

The edge portion formed by the plug pin leading face 59*a'* of the plug pin leading portion 59' and the tip end face is provided with the chamfer 59*b'*. Therefore, the edge portion formed by the plug pin leading face 59*a'* of the plug pin leading portion 59' and the tip end face can be prevented from being caught by the body ceiling face portion 13', thereby eliminating an operation failure caused by an interference between the movable contact piece portion 51' and the body ceiling face portion 13'. High contact reliability, and a sure contact changeover operation of the switch 60' are obtained.

The movable contact piece portion 51' has a form in which circumferential positions of all portions 51*a'*, 51*d'*, 51*b'*, 51*e'*, 51*c'* ranging from the fixed side end portion to the free side end portion are different from one another. Therefore, it is possible to eliminate portions which overlap with each other in a radial direction, the axial distance of which is very short, and which easily interfere with each other in high frequencies, in the portions of the movable contact piece portion 51' ranging from the fixed side end portion to the free side end portion. Furthermore, it is possible to eliminate portions which overlap with each other in a radial direction, which partly enter the plug pin insertion region 15, and which easily interfere with the plug pin 100' in insertion and extraction of the plug pin, in the portions of the movable contact piece portion 51' ranging from the fixed side end portion to the free side end portion, and excluding the free side portion 51*c'*.

As apparent from the above description, according to the first and second embodiments of the invention, the coaxial connectors 1 and 1' with a switch are obtained in which the life property and contact reliability of the movable contact piece portion 51 can be improved, further miniaturization and low-profiling can be realized, and the simple component configuration enables the production cost to be reduced.

What is claimed is:

1. A coaxial connector with a switch wherein said coaxial connectors comprises:

a cylindrical insulation body 10, 10' which integrally has a pedestal portion 11, 11' on a bottom side, and in which a plug pin insertion hole 14, 14' is formed in a center area of an upper face, said plug pin insertion hole enabling a plug pin 100, 100' of a counter connector to be insertable and extractable along a cylinder axis in a center area inside a cylinder;

an external-conductor shell 30, 30' having a cylindrical shell body 31, 31' which is fitted to an outside of the cylinder of said insulation body 10, 10', and a solder connecting portion 32*a*, 32*b*, 32' which elongates integrally from said shell body 31, 31' along a bottom face of said insulation body 10, 10';

a stationary connect member 40, 40' for a switch having a stationary contact portion 41, 41' which is housed and fixed to a position inside the cylinder of said insulation body 10, 10' and deviated from a plug pin insertion region 15, 15', and a solder connecting portion 42, 42' which elongates integrally from said stationary contact portion 41, 41' along the bottom face of said insulation body 10, 10'; and a movable connect member 50, 50' having a plate-spring like movable contact piece portion 51, 51' configured by a thin metal plate, and a solder connecting portion 55, 55' which elongates integrally from said movable contact piece portion 51, 51' along the bottom face of said insulation body 10, 10', said movable contact piece portion being housed in a cantilevered manner inside the cylinder of said insulation body 10, 10' and around said plug pin insertion region 15, 15' so that a plate width direction is in parallel with a direction of insertion and extraction of the plug pin, a free side end portion 54*b*, 15*c'* laterally pass-ing a part of said plug pin insertion region 15, 15' to elongate to said stationary contact portion 41, 41', and having a plug pin contact portion 57, 57' and a movable contact portion 56, 56' which is elastically contacted with said stationary contact portion 41, 41' by a spring force, in accordance with fitting with said counter connector, said plug pin 100, 100' is elastically contacted with said plug pin contact portion 57, 57', and said movable contact piece portion 51, 51' is displaced in a direction substantially perpendicular to the direction of insertion and extraction of the plug pin against the spring force, whereby said movable contact portion 56, 56' is separated from said stationary contact portion 41, 41', wherein, in said insulation body 10, 10', plug pin insertion guide walls 17*a*, 18*a*, 17*a'* are formed at opposed positions across said plug pin insertion region

15, 15' inside the cylinder, said plug pin insertion guide walls hanging continuously from a hole wall of said plug pin insertion hole 14, 14' in the plug pin insertion direction.

2. A coaxial connector with a switch according to claim 1, wherein a plug pin leading portion 59, 59' which is curved toward an outside of said plug pin insertion region 15, 15' is formed in a plug pin insertion side end of said plug pin contact portion 57, 57', and, in said insulation body 10, 10', plug pin insertion guide walls 17*a*, 18*a*, 17*a'* are formed at opposed positions across said plug pin insertion region 15, 15' inside the cylinder, said plug pin insertion guide walls hanging continuously from a hole wall of said plug pin insertion hole 14, 14' in the plug pin insertion direction.

3. A coaxial connector with a switch according to claim 1, wherein a plug pin leading portion 59, 59' which is curved toward an outside of said plug pin insertion region 15, 15' is formed in a plug pin insertion side end of said plug pin contact portion 57, 57', and an edge formed by a plug pin leading face 59*a'* of a plug pin leading portion 59' and a tip end face is provided with a chamfer 59*b'*.

4. A coaxial connector with a switch according to claim 1, wherein a plug pin leading portion 59, 59' which is curved toward an outside of said plug pin insertion region 15, 15' is formed in a plug pin insertion side end of said plug pin contact portion 57, 57', an edge formed by a plug pin leading face 59*a'* of a plug pin leading portion 59' and a tip end face is provided with a chamfer 59*b'*, and, in said insulation body 10, 10', plug pin insertion guide walls 17*a*, 18*a*, 17*a'* are formed at opposed positions across said plug pin insertion region 15, 15' inside the cylinder, said plug pin insertion guide walls hanging continuously from a hole wall of said plug pin insertion hole 14, 14' in the plug pin insertion direction.

* * * * *